US009111440B2

(12) United States Patent
Park et al.

(10) Patent No.: US 9,111,440 B2
(45) Date of Patent: Aug. 18, 2015

(54) REFRIGERATOR AND REMOTE CONTROLLER

(75) Inventors: Hyoungjun Park, Changwon-si (KR); Yanghwan Kim, Changwon-si (KR); Museung Kim, Changwon-si (KR); Jongmi Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 163 days.

(21) Appl. No.: 13/978,497

(22) PCT Filed: Jan. 6, 2012

(86) PCT No.: PCT/KR2012/000177

§ 371 (c)(1),
(2), (4) Date: Aug. 12, 2013

(87) PCT Pub. No.: WO2012/093903

PCT Pub. Date: Jul. 12, 2012

(65) Prior Publication Data

US 2013/0307698 A1 Nov. 21, 2013

(30) Foreign Application Priority Data

Jan. 6, 2011 (KR) ..... 10-2011-0001539
Jan. 6, 2011 (KR) ..... 10-2011-0001540

(51) Int. Cl.

| | |
|---|---|
| ***G08B 7/06*** | (2006.01) |
| ***G08C 17/02*** | (2006.01) |
| *F25D 29/00* | (2006.01) |

(52) U.S. Cl.
CPC ..... *G08C 17/02* (2013.01); *F25B 2600/07* (2013.01); *F25D 29/00* (2013.01); *F25D 2400/36* (2013.01); *F25D 2400/361* (2013.01)

(58) Field of Classification Search
CPC ..... F25D 2400/36; F25D 2400/361
See application file for complete search history.

(56) References Cited

U.S. PATENT DOCUMENTS

| | | | | |
|---|---|---|---|---|
| 7,925,976 | B2 * | 4/2011 | Shin et al. | 715/706 |
| 2008/0195944 | A1 * | 8/2008 | Lee et al. | 715/706 |
| 2010/0283573 | A1 * | 11/2010 | Yum et al. | 340/3.1 |
| 2011/0264286 | A1 * | 10/2011 | Park | 700/286 |
| 2013/0067375 | A1 * | 3/2013 | Kim et al. | 715/769 |

FOREIGN PATENT DOCUMENTS

| | | |
|---|---|---|
| KR | 10-2008-0105927 | 12/2008 |
| KR | 10-2008-0105932 | 12/2008 |
| KR | 10-2009-0074955 | 7/2009 |

* cited by examiner

*Primary Examiner* — Van Trieu
(74) *Attorney, Agent, or Firm* — Dentons US LLP

(57) ABSTRACT

Provided is a refrigerator, which includes a display part and a control part. The display part displays information. The control part controls the display part. The display part includes a first display part for displaying information related to an additional function except for a cooling function, and a second display part for displaying temperature information related to the cooling function.

27 Claims, 42 Drawing Sheets

REFRIGERATOR AND REMOTE CONTROLLER

CROSS-REFERENCE TO RELATED APPLICATIONS

The present application is a national stage entry of International Application No. PCT/KR2012/000177, filed on Jan. 6, 2012, which claims priority under 35 U.S.C. 119 and 35 U.S.C. 365 to Korean Patent Application Nos. 10-2011-0001539 and 10-2011-0001540, both filed on Jan. 6, 2011, all of which is are hereby incorporated by reference in its their entirety.

TECHNICAL FIELD

The present disclosure relates to a refrigerator and a remote controller.

BACKGROUND ART

In general, refrigerators are apparatuses for storing food at low temperature. Such a refrigerator may include one of a refrigerator compartment and a freezer compartment.

Typical refrigerators just perform their original function for storing food at low temperature. However, needs of additional functions except for the original function are being increased in recent years.

DISCLOSURE

Technical Problem

Embodiments provide a refrigerator which displays energy-related information as well as information related to a cooling function as an original function.

Embodiments also provide a remote controller which remotely monitors or controls a refrigerator.

Technical Solution

In one embodiment, a refrigerator includes: a display part for displaying information; and a control part for controlling the display part, wherein the display part includes a first display part for displaying information related to an additional function except for a cooling function, and a second display part for displaying temperature information related to the cooling function.

In another embodiment, a remote controller for controlling or monitoring a component including at least a refrigerator includes: a display part for displaying information about the component; and a control part for controlling an operation of the display part, wherein the display part includes a first user interface (UI) for remotely controlling the component, and at least one second user interface (UI) for performing a function except for the remotely controlling.

The details of one or more embodiments are set forth in the accompanying drawings and the description below. Other features will be apparent from the description and drawings, and from the claims.

Advantageous Effects

According to the embodiments, since the refrigerator can communicate with the communication component, the refrigerator can recognizes power cost.

Accordingly, the power cost can be displayed on the display part. Thus, a user can operate the refrigerator within a time period when power cost is low, thereby reducing power usage cost.

In addition, since the refrigerator can recognizes power cost, power usage information can be displayed on the display part.

In addition, expiration date information of a food can be checked without separate manipulation outside a refrigerator.

In addition, since an operation state of a component can be checked on the remote controller, the component can be controlled more effectively.

In addition, since information about a food stored in the refrigerator can be displayed on the remote controller, a user can check the information about the food stored in the refrigerator, without opening a door of the refrigerator.

DESCRIPTION OF DRAWINGS

FIG. 6 is a view illustrating an example of a screen displayed when the smart grid selection part is selected on the screen of FIG. 3 or 4 in a state where the smart grid function is turned on.

MODE FOR INVENTION

Reference will now be made in detail to embodiments of the present disclosure, examples of which are illustrated in the accompanying drawings.

Figure 1:
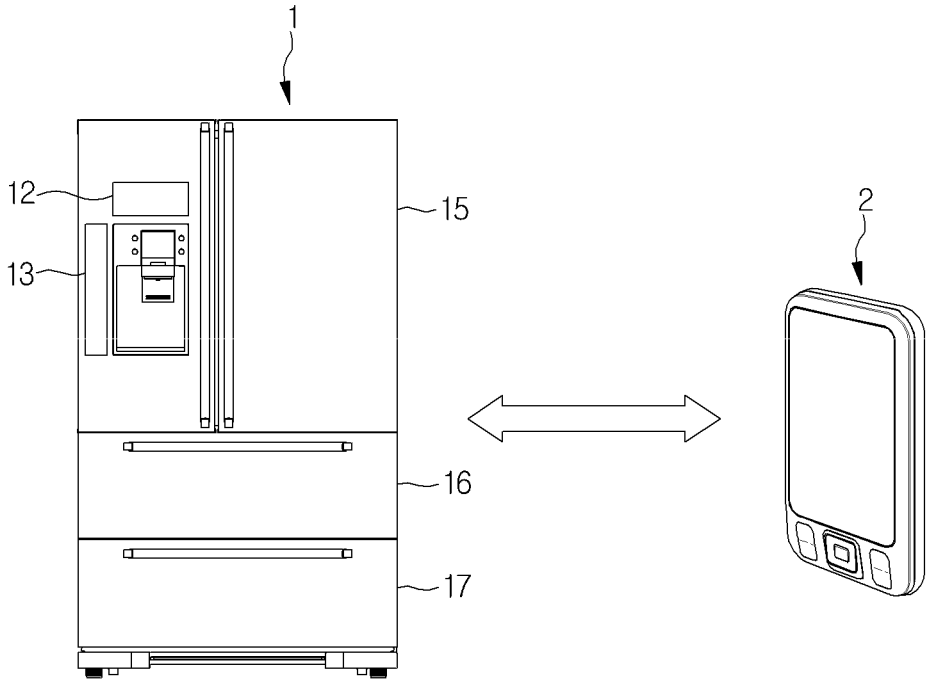
FIG. 1 is a schematic view illustrating a network device including a refrigerator according to an embodiment.
Figure 2:
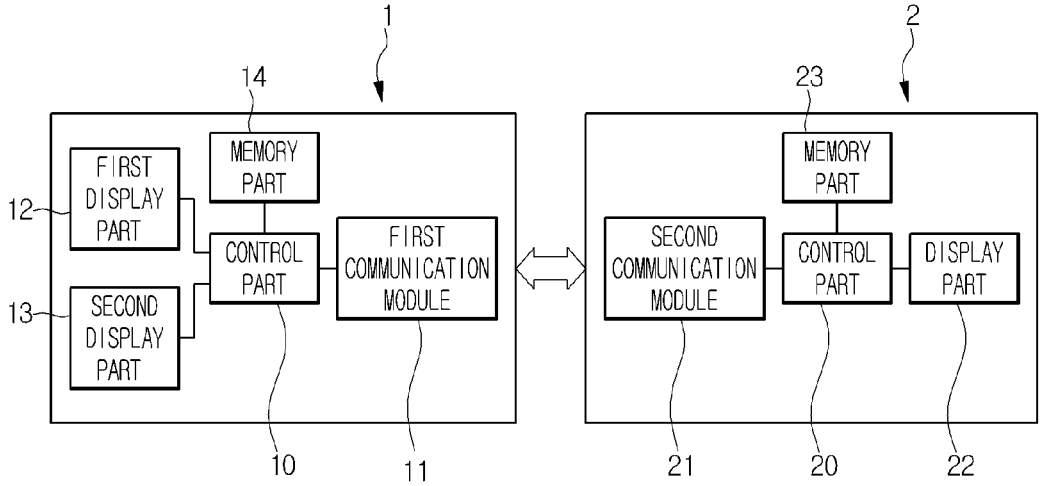
FIG. 2 is a block diagram illustrating a network device including a refrigerator according to an embodiment.

FIG. 1 is a schematic view illustrating a network device including a refrigerator according to an embodiment. FIG. 2 is a block diagram illustrating the network device including the refrigerator according to an embodiment.

Referring to FIGS. 1 and 2, a network device according to an embodiment includes a refrigerator 1, and a communication component 2 communicating with the refrigerator 1 through a wire or wireless connection.

The refrigerator may be a top mount type refrigerator in which a freezer compartment is disposed over a refrigerator compartment; a side-by-side type refrigerator in which a freezer compartment and a refrigerator compartment are disposed side by side; and a bottom freezer type refrigerator in which a freezer compartment is disposed under a refrigerator compartment, but is not limited thereto. The refrigerator may include at least one of a refrigerator compartment and a freezer compartment. Hereinafter, a bottom freezer type refrigerator will now be exemplified as the refrigerator 1.

The communication component 2 may be a remote controller for remotely controlling a home appliance or the refrigerator 1. The remote controller may be a smart phone or a portable PC.

The refrigerator 1 may include a refrigerator compartment, a freezer compartment, a switching compartment, a refrigerator compartment door 15, a freezer compartment door 17, and a switching compartment door 16. The switch compartment may function as a refrigerator compartment or a freezer compartment according to a temperature adjustment, or function as a separate storage at temperature between temperature of a refrigerator compartment and temperature of a freezer compartment. The switch compartment may be removed from the refrigerator 1.

The refrigerator 1 may transmit its information to the communication component 2 and receive energy-related information (hereinafter, referred to as "energy information") and an operation command from the communication component 2.

The refrigerator 1 may include: a first communication module 11 directly or indirectly communicating with the communication component 2; a first display part 12 for displaying, at least, stored food information and information received from the outside; a second display part 13 for displaying operation state information; a memory part 14 for storing various types of information; and a control part 10 for controlling at least the first and second display parts 12 and 13. The control part 10 may control an overall operation of the refrigerator 1.

At least one of energy information received from the communication component 2, additional information except for the energy information (which will be described later), diagnosis information, and stored food information may be displayed on the first display part 12. The first display part 12 may include a touch screen for inputting a command to a displayed screen by using a touch type input method. That is, information related to an additional function except for a cooling function of the refrigerator 1 may be displayed on the first display part 12.

Temperature information related to the cooling function of the refrigerator 1 may be displayed on the second display part 13. That is, at least one of freezer compartment temperature, refrigerator compartment temperature, lighting, on/off states of an ice maker, and the form of ice may be displayed on the second display part 13. Although the first and second display parts 12 and 13 are separated from each other, first and second display parts may be integrated into a single display part. That is, information otherwise displayed on a first display part, and information otherwise displayed on a second display part may be displayed together or separately on a single display part. For another example, when a single display part is provided, first and second display parts may be separated by a contents region or a display region.

The memory part 14 may store at least one of the state information of the refrigerator 1, the energy information received from the communication component 2, the additional information except the energy information, the diagnosis information, and the stored food information.

The communication component 2 may include a second communication module 21 communicating with the first communication module 11, a display part 22 for displaying various types of information, a memory part 23 for storing various types of information, and a control part 20 for controlling at least the display part 22. The control part 20 controls the communication component 2 to perform an original function thereof (at least a function of the display part 22), and additionally, to control or monitor the refrigerator 1.

The display part 22 may display information of the communication component 2 and information of the refrigerator 1. The memory part 23 may store the information of the communication component 2 and the information of the refrigerator 1. The information of the refrigerator 1 may include operation information of the refrigerator 1, stored food information, energy information related to an operation of the refrigerator 1 and additional information except for the energy information.

For example, each of the first and second communication modules 11 and 21 may be a WiFi module. However, the present disclosure is not limited to a communication manner of each of the communication modules. For example, each of the communication modules may be a Bluetooth module or a Zigbee module.

The first and second communication modules 11 and 21 may directly communicate with each other. That is, the first and second communication modules 11 and 21 may directly communicate with each other using a WiFi-direct technology or an Ad-Hoc mode (or network) without using a wireless access point. In detail, the WiFi-direct technology represents a technology through which communication modules communicate with each other at a fast rate using a communication standard such as WiFi 802.11 a/b/g/n, irrespective of the installation of the access point. That is, the refrigerator 1 and the communication component 2 may communicate with each other without using the access point. This technology connects the refrigerator 1 to the communication component 2 through a wireless WiFi connection without using an Internet network, which is recently popular.

The Ad-Hoc mode (or the Ad-Hoc network) may be a network which is constituted by only a mobile host without having a fixed wired network. Thus, since the movement of the host is not limited and a wired network and a base station are not required, the Ad-Hoc mode (or the Ad-Hoc network) has a fast net composition and is inexpensive. That is, the first and second communication modules 11 and 21 may communicate with each other through a wireless connection without using the access point. Thus, in the Ad-Hoc mode, the refrigerator 1 and the communication component 2 may wirelessly communicate with each other without using the access point.

The Bluetooth communication is widely known near field communication. That is, wireless communication may be allowable within a specific range through a pairing process between the Bluetooth module connected to the refrigerator 1 and the Bluetooth module connected to the communication component 2.

Alternatively, the first and second communication modules 11 and 21 may communicate with each other through the access point or through an access point and a server (e.g., web server).

Figure 3:
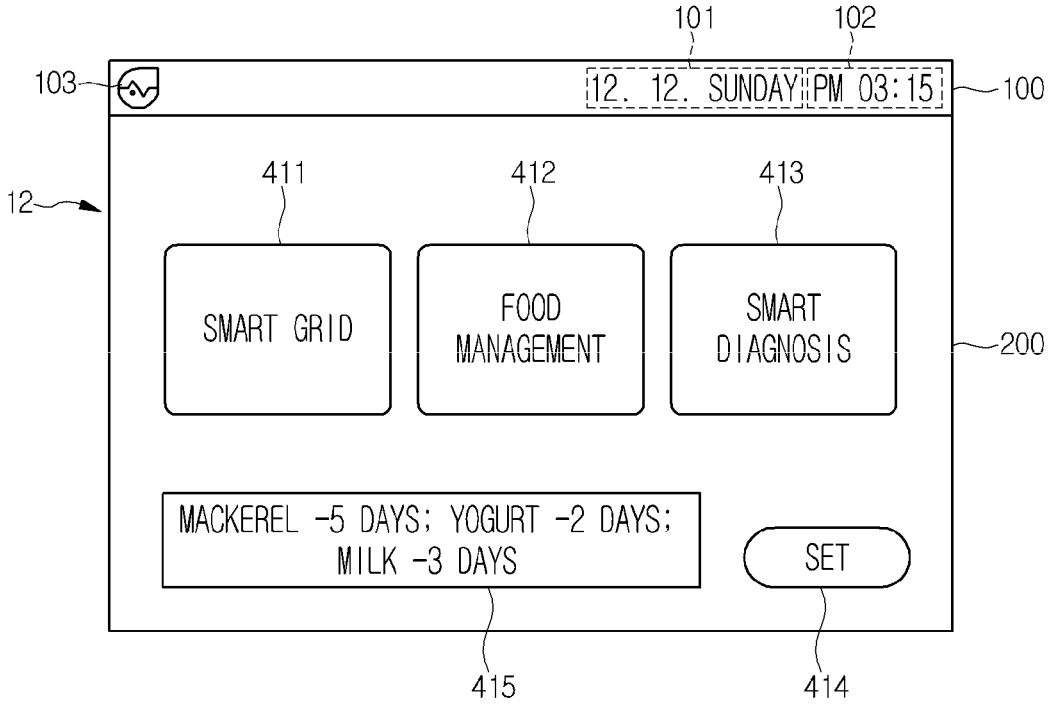
FIG. 3 is a view illustrating an example of a first display part of a refrigerator according to an embodiment.

FIG. 3 is a view illustrating an example of the first display part of the refrigerator according to an embodiment.

Referring to FIGS. 2 and 3, a screen displayed on the first display part 12 may include a first screen 100 and a second screen 200. For example, when the refrigerator 1 is turned on, the screen illustrated in FIG. 3 may be displayed. The screen of FIG. 3 may be an initial screen of the first display part 12. For example, the first and second screens 100 and 200 may be vertically or horizontally arrayed. The first and second screens 100 and 200 may be independent screens, or be separated by displayed contents.

Date information 101, time information 102, smart grid function on/off information 103 may be displayed on the first screen 100. The smart grid function on/off information 103 may be varied according to on/off states. For example, displayed smart grid function information may be varied in color, brightness, and chroma according to on/off states.

When a smart grid function is turned on, the refrigerator 1 may be operated based on energy information. The operation of the refrigerator 1 on the basis of the energy information may represent that the refrigerator 1 performs a course on the basis of the energy information, or displays the energy information. Alternatively, the refrigerator 1 may be operated on the basis of additional information except for the energy information. The energy information and the additional information except for the energy information may be received from the communication component 2.

The energy information may be information related to one of energy sources such as electricity, water, and gas. In the current embodiment, the energy information is exemplified as information related to electricity. For example, examples of the electricity-related information may include time-based pricing, curtailment, grid emergency, grid reliability, energy increment, energy generation amount, operation priority, and energy consumption amount. In the current embodiment, energy-related costs may be referred to as energy costs. That is, the energy information may be classified into cost information (energy costs) and information (the curtailment, the grid emergency, the grid reliability, the energy generation amount, the energy increment, the operation priority, and the energy consumption amount) except for the costs. The energy information may be classified into scheduled information generated in advance on the basis of previous information, and real time information varying in real-time. The scheduled information and the real time information may be classified by whether information (of future) after the current time is predicted.

Also, the energy information may be classified into time-of-use (TOU) information, critical-peak-pattern (CPP) information, and real-time-pattern (RTP) information according to a change pattern of data depending on a time. Also, the energy information may be varied according to time.

According to the TOU information, time-based electricity costs (e.g., costs per unit power) may be changed in phases. According to the CPP information, electricity costs are varied in phases or in real-time according to time, and are emphasized at a specific time point. That is, normal costs of the CPP pattern may be lower than those of the TOU pattern. However, the costs of the CPP pattern may be significantly higher at a specific time point than those of the TOU pattern. According to the RTP information, time-based electricity costs may be varied in real-time.

The energy information may be transmitted or received as true or false signals such as Boolean, or actual price information may be transmitted or received. Alternatively, the energy information may be leveled in plurality, and then the leveled energy information may be transmitted or received. When the refrigerator 1 or the communication component 2 receives true or false signals such as the Boolean, one signal may be recognized as an on-peak signal, and the other signal may be recognized as an off-peak signal.

On the other hand, the refrigerator 1 or the communication component 2 may recognize at least one driving information including the electricity cost. Also, the refrigerator 1 or the communication component 2 may compare a recognized information value to a reference information value to recognize an on-peak and an off-peak.

For example, when the refrigerator 1 or the communication component 2 recognizes the leveled information or the actual price information, the refrigerator 1 or the communication component 2 may compare the recognized information value to the reference information value to recognize the on-peak and the off-peak.

Here, a driving-related information value may be at least one of an electricity cost, a power amount, a variation of the electricity cost, a variation of the powder amount, a mean value of the electricity cost, and a mean value of the power amount. The reference information value may be at least one of a mean value of the power amount, a mean value of maximum and minimum values of the power information during a predetermined period, a reference variation (for example, an inclination of a power consumption amount per unit time) of the powder information during a predetermined period. The reference information value may be set in real time or in advance. The additional information except for the energy information may include at least one of environment information, program update information, time information, operation or state information (e.g., breakdown) of each component, and habit information of a consumer utilizing the refrigerator 1. The environment information may include the discharge amount of carbon dioxide, a concentration of carbon dioxide within air, temperature, humidity, the amount of rainfall, whether it rains, solar radiation, and wind quantity.

The second screen 200 may display at least one of a smart grid selection part 411, a food management selection part 412, and a smart diagnosis selection part 413. In FIG. 3, the smart grid selection part 411, the food management selection part 412, and the smart diagnosis selection part 413 are displayed all. For example, when the smart grid selection part 411 is selected, energy information may be checked. When the food management selection part 412 is selected, information about stored food may be checked. When the smart diagnosis selection part 413 is selected, an error of the refrigerator 1 may be diagnosed.

Stored food-related information 415 and a set selection part 414 may be displayed on the second screen 200. For example, the stored food-related information 415 may be expiration date information of a stored food. Information about the stored food may be displayed using a sliding text method. For example, as the stored food-related information 415, expiration date information of foods stored in the refrigerator 1 may be moved horizontally or vertically. In this case, the expiration date information may be displayed within a specific region. For another example, the stored food-related information 415 may be a stationary text. For example, expiration date information of stored foods may be displayed. In this case, information about foods close to the expiration dates thereof, or information about foods after the expiration dates thereof may be displayed.

According to the current embodiment, expiration date information of a food can be checked without separate manipulation outside a refrigerator.

Figure 4:
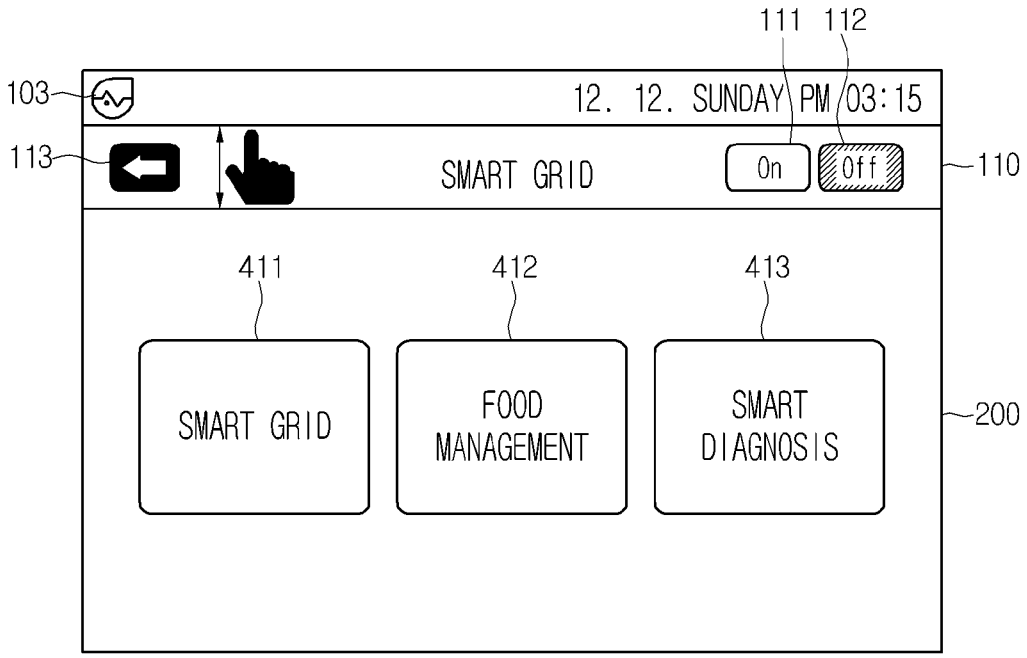
FIG. 4 is a view illustrating an example of a screen for selecting on/off states of a smart grid function according an embodiment.

FIG. 4 is a view illustrating an example of a screen for selecting on/off states of the smart grid function according to an embodiment.

Referring to FIGS. 3 and 4, when the boundary between the first screen 100 and the second screen 200, or the upper portion of the second screen 200 is touched and pulled down on the screen of FIG. 3, a smart grid information screen 110 may be displayed. When the smart grid information screen 110 is displayed, the stored food-related information 415 and the set selection part 414 may disappear on the second screen 200. An ON selection part 111 and an OFF selection part 112 may be displayed on the smart grid information screen 110. When the ON selection part 111 is selected, the smart grid function is turned on. When the OFF selection part 112 is selected, the smart grid function is turned off.

Alternatively, a single selection part may be displayed on the smart grid information screen 110. In this case, the smart grid function may be turned on or off according to the number of pressing the single selection part. A previous screen selection part 113 for a movement to the previous screen (of FIG. 3) may be displayed on the smart grid information screen 110. When the previous screen selection part 113 is selected, the smart grid information screen 110 disappears. Alternatively, when the smart grid information screen 110 is touched and moved upward, the smart grid information screen 110 may disappear. For another example, when the smart grid function on/off information 103 is selected on the screen of FIG. 3, a pop up screen including an ON selection part and an OFF selection part, or a pop up screen including a single selection part may be displayed.

The smart grid information screen 110 may be a portion of the second screen 200 or a screen separated from the second screen 200.

Figure 5:
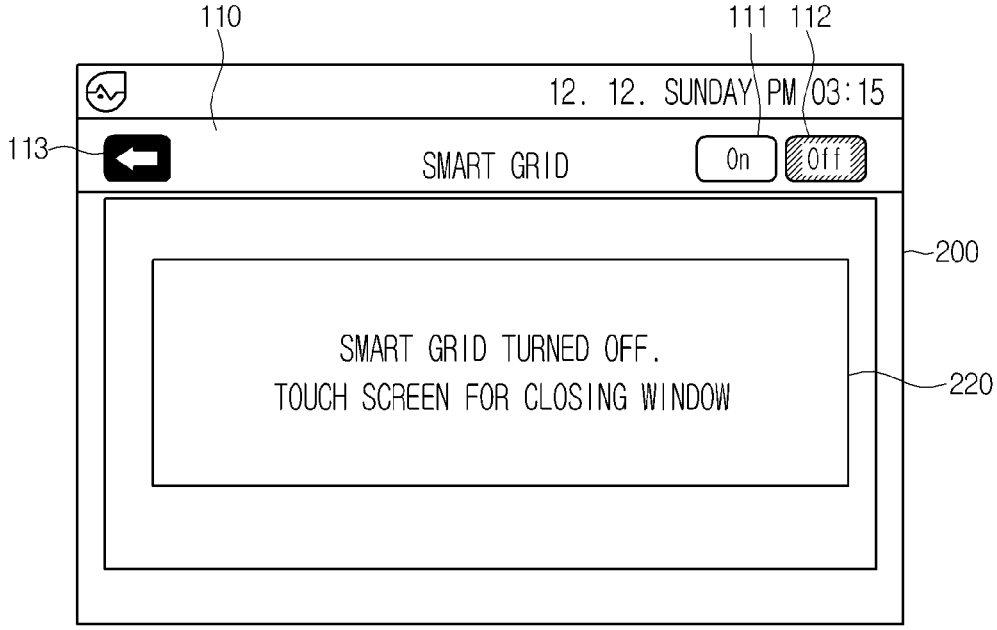
FIG. 5 is a view illustrating an example of a screen displayed when a smart grid selection part is selected on the screen of FIG. 3 or 4 in a state where a smart grid function is turned off.

FIG. 5 is a view illustrating an example of a screen displayed when the smart grid selection part is selected on the screen of FIG. 3 or 4 in a state where the smart grid function is turned off.

Referring to FIGS. 3 to 5, when the smart grid selection part 411 is selected on the screen of FIG. 3 or 4 in the state where the smart grid function is turned off, a smart grid off notice screen 220 may be displayed on the second screen 200. Additionally, the smart grid information screen 110 may be displayed on the second screen 200. Alternatively, the smart grid information screen 110 separated from the second screen 200 may be displayed together with the second screen 200.

The information displayed on the smart grid off notice screen 220 may include, e.g., sentences "Smart grid turned off. Touch screen for closing window". When the smart grid off notice screen 220 is selected, the smart grid notice screen 220 may disappear, and then the screen of FIG. 3 may be displayed again.

When the ON selection part 111 is selected on the smart grid information screen 110, the smart grid function is turned on. When the smart grid function is turned on, the current screen may be changed to the screen of FIG. 6, which will be described later.

Figure 6:
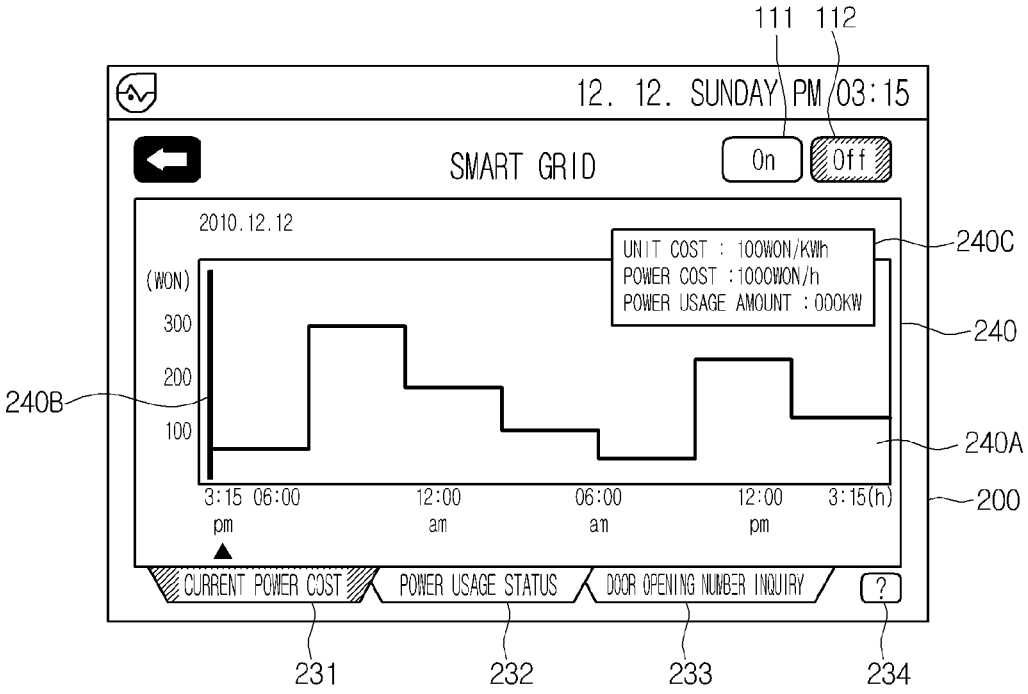

FIG. 6 is a view illustrating an example of a screen displayed when the smart grid selection part is selected on the screen of FIG. 3 or 4 in a state where the smart grid function is turned on.

Referring to FIG. 6, in the state where the smart grid function is turned on, when the smart grid selection part 411 is selected on the screen of FIG. 3, or the ON selection part 111 is selected the screen of FIG. 5, a power cost screen 240 may be displayed on the second screen 200. Graph information 240A (e.g., a line graph) related to power cost may be displayed on the power cost screen 240. The graph information 240A related to the power cost may be hourly cost graph information. In the graph information 240A, a horizontal axis may represent time, and a vertical axis may represent cost. Also, an initial time (a reference time) on the horizontal axis may be the current time, and the last time may be a time after 24 hours from the current time. That is, a time range may be about 24 hours in the graph information 240A. Also, the graph information 240A may include power cost information for 24 hours. In the current embodiment, the time range may be manually or automatically changed or set. Thus, the present disclosure is not limited to the time range. The initial time may be disposed on the left side of the screen on which the graph information 240A is displayed, and the last time may be disposed on the right side thereof. Alternatively, the initial time may be disposed on the right side of the screen on which the graph information 240A is displayed, and the last time may be disposed on the left side thereof.

The hourly cost graph may be divided into a plurality of levels and thus the hourly cost graph having the plurality of levels may be displayed. The levels of the hourly cost graph may have different colors.

An operation time display part 240B may be displayed on the power cost screen 240. The operation time display part 240B may be disposed on a position corresponding to the current time of the graph information 240A. The operation time display part 240B may have a line or bar graph shape. Since the initial time is the current time on the horizontal axis, the operation time display part 240B may be disposed to correspond to the current time.

The power cost screen 240 may be periodically updated. For example, the power cost screen 240 may be updated every 15 minutes. Referring to FIG. 6, when a time elapsed from the current time, i.e., 3:15 P.M., is about 15 minutes, the current time (the reference time) may be updated to 3:30 P.M., and the last time may be updated to 3:30 P.M. The present disclosure is not limited to the updating period of the power cost screen 240.

Character information 240C related to power cost may be additionally displayed on the power cost screen 240. The character information 240C related to power cost may include at least one of unit cost (cost per unit power), power cost (usage cost per time), and a power usage amount. That is, information related to power costs having different patterns may be displayed on the power cost screen 240.

In the state where the smart grid function is turned on, when the smart grid selection part 411 is selected on the screen of FIG. 3 or 4, or the ON selection part 111 is selected on the screen of FIG. 5, at least one of a current power cost selection part 231, a power usage status selection part 232, a door opening number inquiry selection part 233, and a help selection part 234 may be additionally displayed on the second screen 200. For example, the screen of FIG. 6 may display the current power cost selection part 231, the power usage status selection part 232, the door opening number inquiry selection part 233, and the help selection part 234. The current power cost selection part 231, the power usage status selection part 232, the door opening number inquiry selection part 233, and the help selection part 234 may be separately displayed. That is, the current power cost selection part 231, the power usage status selection part 232, the door opening number inquiry selection part 233, and the help selection part 234 may be different in color, brightness, and chroma. For example, one selection part selected from the current power cost selection part 231, the power usage status selection part 232, the door opening number inquiry selection part 233, and the help selection part 234 may be darker than the others as illustrated in FIG. 6.

In the state where the smart grid function is turned on, when the smart grid selection part 411 is selected on the screen of FIG. 3 or 4, or the ON selection part 111 is selected on the screen of FIG. 5, the power cost screen 240 may be set to be fundamentally displayed on the second screen 200. Thus, the current power cost selection part 231 may be darker than the other selection parts 232, 233, and 234. Alternatively, in the state where the smart grid function is turned on, when the smart grid selection part 411 is selected on the screen of FIG. 3 or 4, or the ON selection part 111 is selected on the screen of FIG. 5, a power usage information screen (that will be described later) or a door opening number information screen (that will be described later) may be set to be fundamentally displayed on the second screen 200. The power usage information screen may include at least one of a power usage cost screen and a power usage amount screen.

Figure 7:
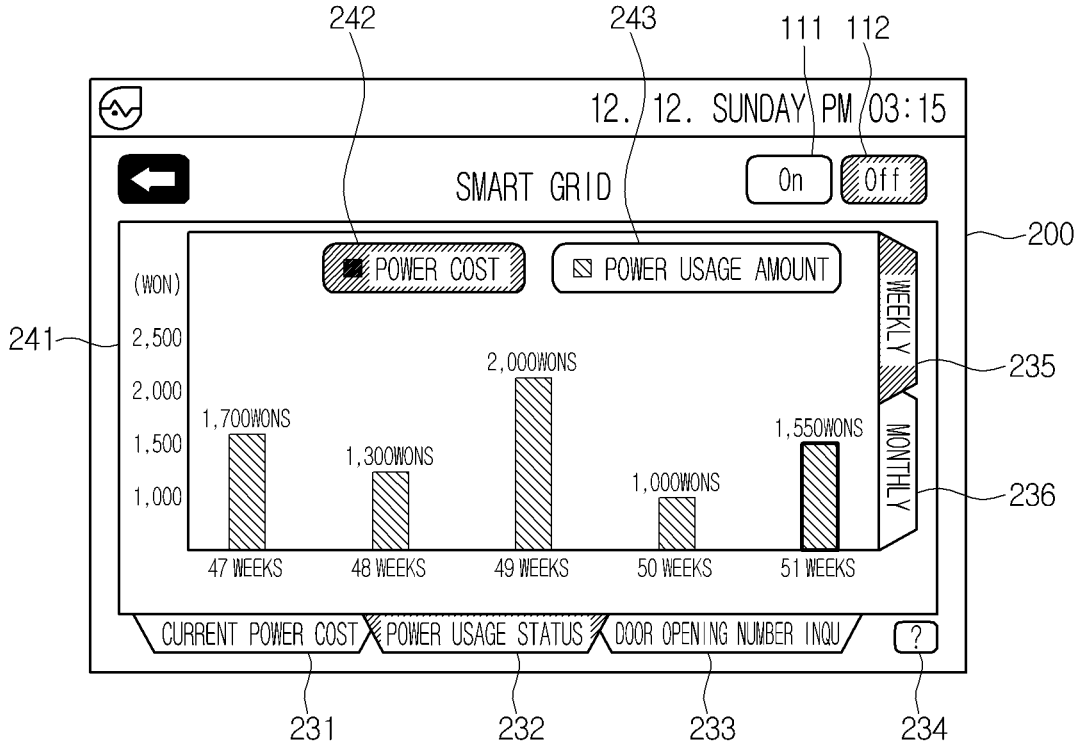
FIG. 7 is a view illustrating a screen displayed when a power usage status selection part is selected on the screen of FIG. 6.

FIG. 7 is a view illustrating a screen displayed when a power usage status selection part is selected on the screen of FIG. 6.

Referring to FIGS. 6 and 7, when the power usage status selection part 232 is selected on the screen of FIG. 6, a weekly power usage cost screen 241 may be displayed. Power usage costs may be displayed in a bar graph form on the weekly power usage cost screen 241. However, the present disclosure is not limited to the bar graph form, and thus, weekly power usage costs may be displayed in line graph, character, or numerical form.

A weekly selection part 235 and a monthly selection part 236 may be displayed on the weekly power usage cost screen 241. A power cost selection part 242 for selecting a power usage cost, and a power usage amount selection part 243 for selecting a power usage amount may be displayed on the weekly power usage cost screen 241.

Power usage cost information for at least two weeks may be displayed on the weekly power usage cost screen 241. Although power usage cost information for recent five weeks is displayed in FIG. 7, the number of displayed weeks is not limited thereto. Information for the latest week may be located at the right side, and information for the previous weeks may be sequentially arrayed to the left side from the information for the latest week. On the contrary, the information for the latest week may be located at the left side, and the information for the previous weeks may be sequentially arrayed to the right side from the information for the latest week. As a weekly usage cost increases, the length of a bar in a graph may increase.

A numeral denoting a power usage cost and corresponding to a displayed bar may be additionally displayed on the weekly power usage cost screen 241.

Among the power usage cost information for at least two weeks, the information about a current week may be different from the information about a previous week in color, brightness, and chroma.

Figure 8:
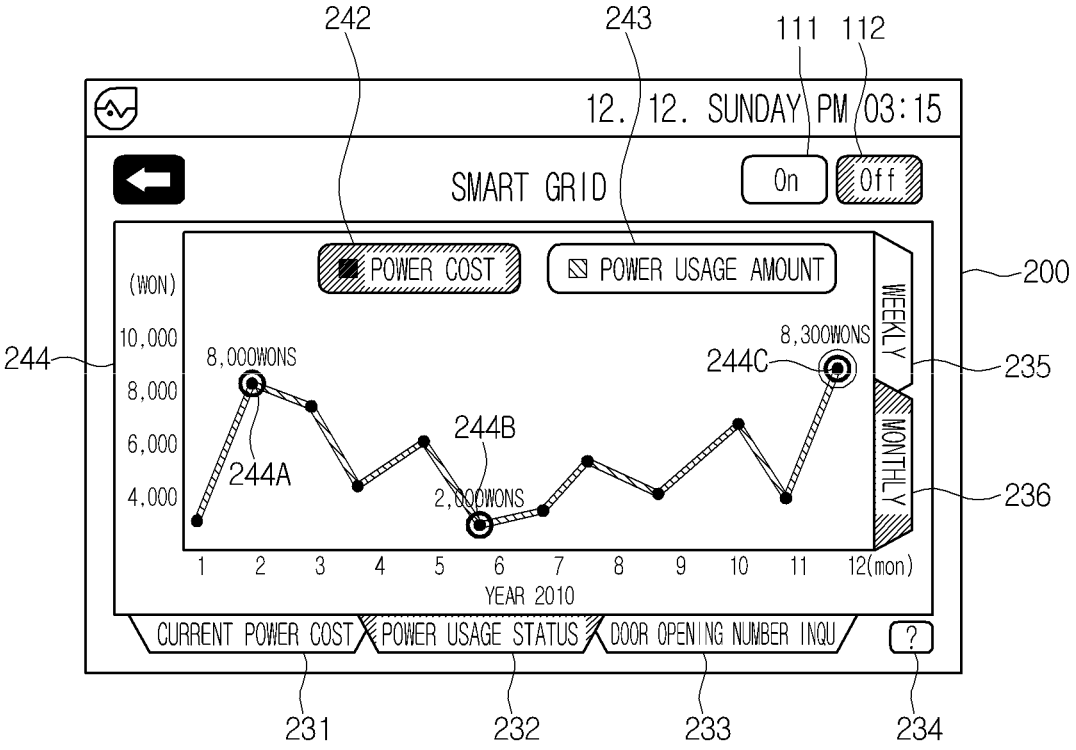
FIG. 8 is a view illustrating an example of a screen displayed when a monthly selection part is selected on the screen of FIG. 7.

FIG. 8 is a view illustrating an example of a screen displayed when the monthly selection part is selected on the screen of FIG. 7.

Referring to FIGS. 7 and 8, when the monthly selection part 236 is selected on the screen of FIG. 7, a monthly power usage cost screen 244 may be displayed. Power usage costs may be displayed in a line graph form on the monthly power usage cost screen 244. However, the present disclosure is not limited to the line graph form, and thus, monthly power usage costs may be displayed in bar graph, character, or numerical form.

Power usage cost information for a plurality of months may be displayed on the monthly power usage cost screen 244. Although power usage cost information for recent twelve months is displayed in FIG. 8, the number of displayed months is not limited thereto. Information for the latest month may be located at the right side, and information for the previous months may be sequentially arrayed to the left side from the information for the latest month. On the contrary, the information for the latest month may be located at the left side, and the information for the previous months may be sequentially arrayed to the right side from the information for the latest month.

Information about a highest usage cost month 244A, a lowest usage cost month 244B, and a current month 244C, and power usage costs corresponding thereto may be displayed in the line graph on the monthly power usage cost screen 244.

Figure 9:
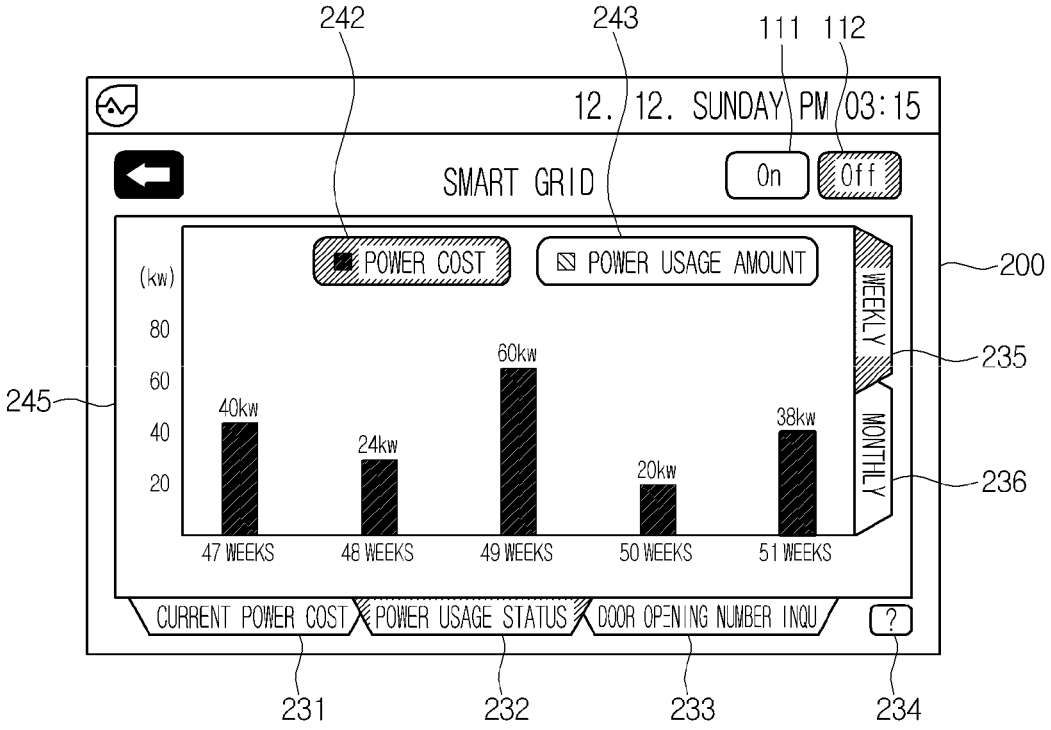
FIG. 9 is a view illustrating an example of a screen displayed when a power usage status selection part is selected on the screen of FIG. 7.

FIG. 9 is a view illustrating an example of a screen displayed when the power usage status selection part is selected on the screen of FIG. 7.

Referring to FIGS. 7 and 9, when the power usage amount selection part 243 is selected on the screen of FIG. 7, a weekly power usage amount screen 245 may be displayed. Power usage amounts may be displayed in a bar graph form on the weekly power usage amount screen 245. However, the present disclosure is not limited to the bar graph form, and thus, weekly power usage amounts may be displayed in line graph, character, or numerical form.

The weekly selection part 235 and the monthly selection part 236 may be displayed on the weekly power usage amount screen 245. Power usage amount information for at least two weeks may be displayed on the weekly power usage amount screen 245. Although power usage amount information for recent five weeks is displayed in FIG. 9, the number of displayed weeks is not limited thereto. Information for the latest week may be located at the right side, and information for the previous weeks may be sequentially arrayed to the left side from the information for the latest week. On the contrary, the information for the latest week may be located at the left side, and the information for the previous weeks may be sequentially arrayed to the right side from the information for the latest week. As a weekly usage amount increases, the length of a bar in a graph may increase.

Figure 10:
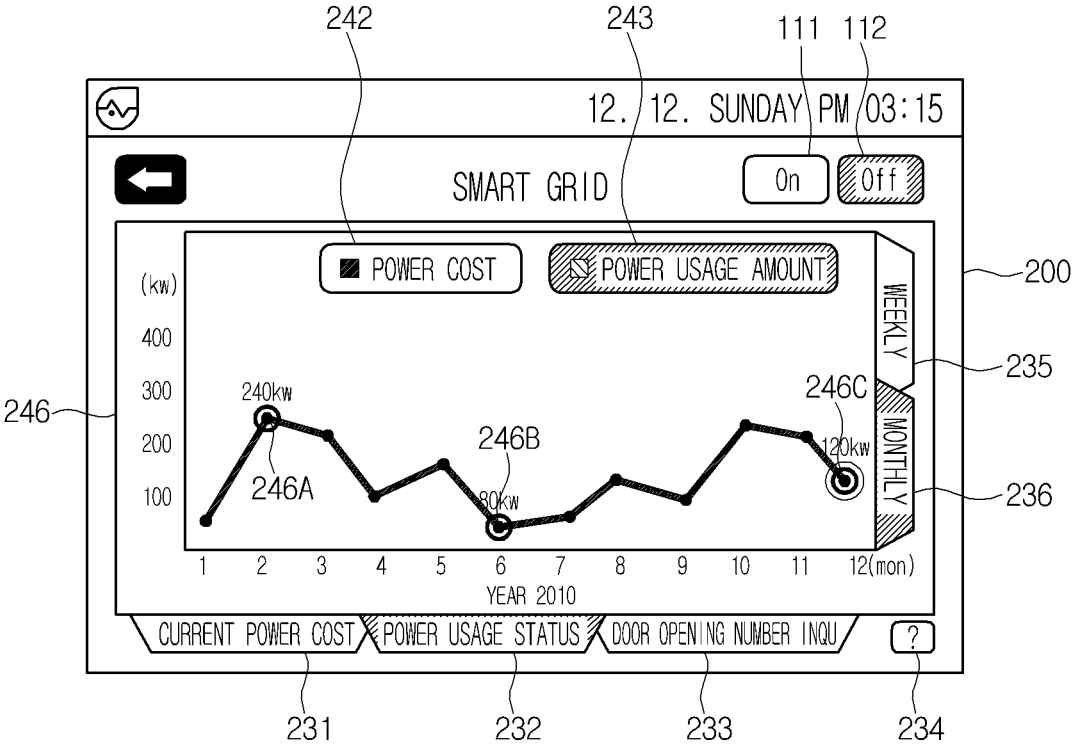
FIG. 10 is a view illustrating an example of a screen displayed when the monthly selection part is selected on the screen of FIG. 9.

FIG. 10 is a view illustrating an example of a screen displayed when the monthly selection part is selected on the screen of FIG. 9.

Referring to FIGS. 9 and 10, when the monthly selection part 236 is selected on the screen of FIG. 9, a monthly power usage amount screen 246 may be displayed. Power usage amounts may be displayed in a ling graph form on the monthly power usage amount screen 246. However, the present disclosure is not limited to the line graph form, and thus, monthly power usage amounts may be displayed in bar graph, character, or numerical form.

Power usage amount information for a plurality of months may be displayed on the monthly power usage amount screen 246. Although power usage amount information for recent twelve months is displayed in FIG. 10, the number of displayed months is not limited thereto. Information for the latest month may be located at the right side, and information for the previous months may be sequentially arrayed to the left side from the information for the latest month. On the contrary, the information for the latest month may be located at the left side, and the information for the previous months may be sequentially arrayed to the right side from the information for the latest month.

Information about a highest usage cost month 246A, a lowest usage cost month 246B, and a current month 246C, and power usage amounts corresponding thereto may be displayed in the line graph on the monthly power usage amount screen 246.

Although the weekly power usage cost screen 241 is displayed as illustrated in FIG. 7 when the power usage status selection part 232 is selected on the screen of FIG. 6, the monthly power usage cost screen 244, the weekly power usage amount screen 245, or the monthly power usage amount screen 246 may be displayed.

Figure 11:
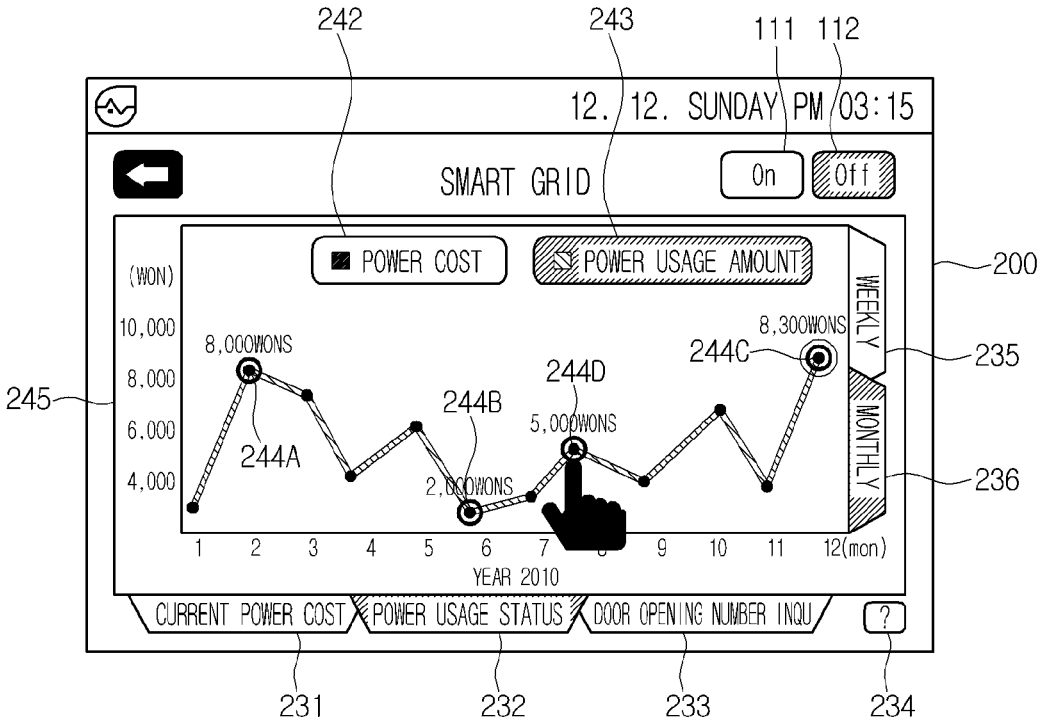
FIG. 11 is a view illustrating an example of a screen displayed when a specific month is selected on the screen of FIG. 10.

FIG. 11 is a view illustrating an example of a screen displayed when a specific month is selected on the screen of FIG. 10.

Referring to FIG. 11, when a specific month (e.g., July) is selected in the line graph on the monthly power usage cost screen 244, a power usage cost for the selected month may be displayed. After a certain time, the power usage cost for the selected month may disappear. That is, information about the highest usage cost month 244A, the lowest usage cost month 244B, the current month 244C, a selected month 244D, and power usage costs corresponding thereto may be displayed in the line graph on the monthly power usage cost screen 244.

In a same manner as that of FIG. 11, the monthly power usage amount screen 246 of FIG. 10 may be described.

Furthermore, not only the second screen, but also the first screen and the smart grid information screen may be further displayed on the screens of FIGS. 6 to 11.

Although weekly information and monthly information may be displayed in FIGS. 7 to 11, daily information may be displayed.

Figure 12:
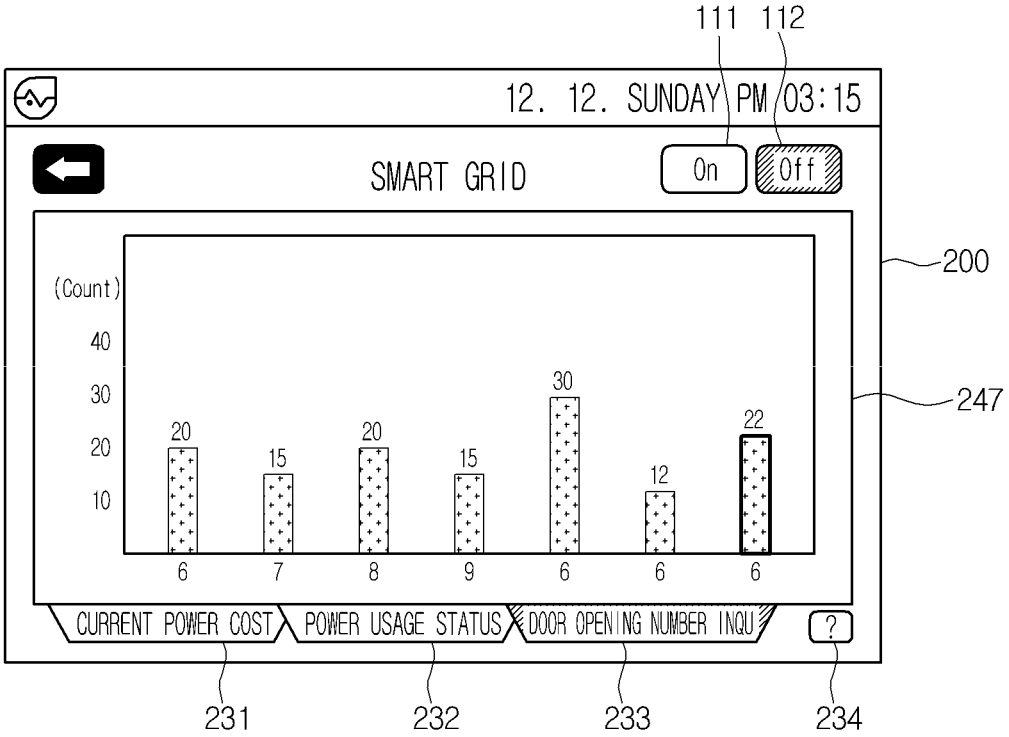
FIG. 12 is a view illustrating an example of a screen displayed when a door opening number inquiry selection part is selected on one of the screens of FIGS. 7 to 11.

FIG. 12 is a view illustrating an example of a screen displayed when a door opening number inquiry selection part is selected on one of the screens of FIGS. 7 to 11.

Referring to FIG. 12, when the door opening number inquiry selection part 233 is selected on one of the screens of FIGS. 7 to 11, a door opening number information screen 247 may be displayed on the second screen 200. The daily number of times of opening a door may be displayed in a bar graph form on the door opening number information screen 247. However, the present disclosure is not limited to the bar graph form, and thus, the daily number of times of opening a door may be displayed in line graph, character, or numerical form.

Door opening number information for two or more days may be displayed on the door opening number information screen 247. Although door opening number information for recent seven days is displayed in FIG. 12, the number of displayed days is not limited thereto. Information corresponding to today may be located at the right side, and information corresponding to the previous days may be sequentially arrayed to the left side from the information corresponding to today. On the contrary, information corresponding to today may be located at the left side, and information corresponding to the previous days may be sequentially arrayed to the right side from the information corresponding to today. As the number of times of opening a door increases, the length of a bar in a graph may increase.

According to the embodiments, since the refrigerator can communicate with the communication component, the refrigerator can recognizes power cost. Accordingly, the power cost can be displayed on the display part. Thus, a user can operate the refrigerator within a time period when power cost is low, thereby reducing power usage cost.

In addition, since the refrigerator can recognizes power cost, power usage information can be displayed on the display part. In addition, since the door opening number information can be displayed on the display part, a user can be induced to reduce the number of opening a door.

Figure 13:
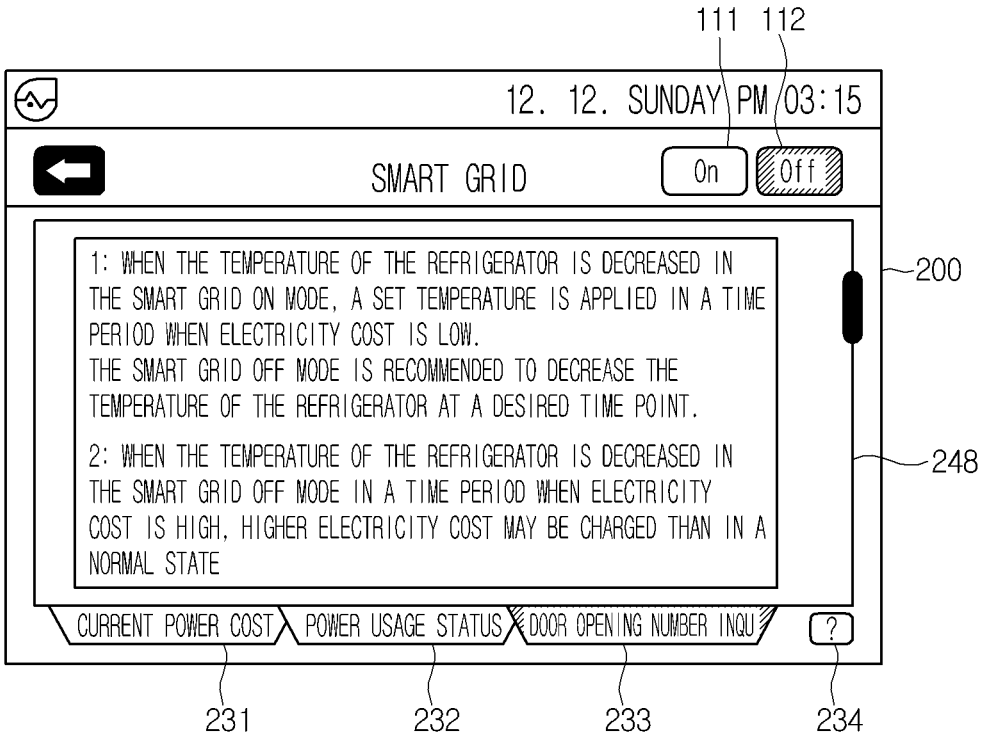
FIG. 13 is a view illustrating an example of a screen displayed when a help selection part is selected on one of the screens of FIGS. 7 to 11.

FIG. 13 is a view illustrating an example of a screen displayed when a help selection part is selected on one of the screens of FIGS. 7 to 11.

Referring to FIG. 13, when the help selection part 234 is selected on one of the screens of FIGS. 7 to 11, help information may be displayed on the second screen 200. For example, the help information may be text information. For example, the help information may include a description of the smart grid function and a description of an operation of the refrigerator.

Figure 14:
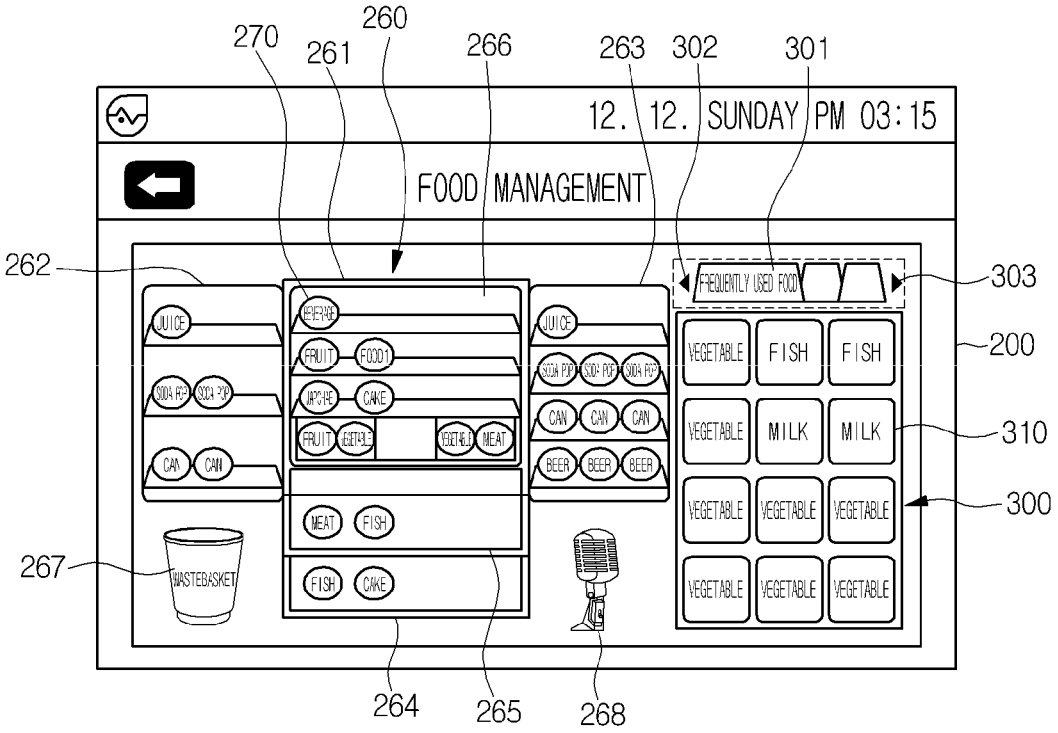
FIG. 14 is a view illustrating an example of a screen displayed when a food management selection part is selected on the screen of FIG. 3 or 4.

FIG. 14 is a view illustrating an example of a screen displayed when the food management selection part is selected on the screen of FIG. 3 or 4.

Referring to FIG. 14, when the food management selection part 412 is selected on the screen of FIG. 3 or 4, a stored food position information screen 260 (hereinafter, referred to as a 'food position information screen') for displaying the position of stored food, and a food list information screen 300 including display information of food to be added to the food position information screen 260 may be displayed on the second screen 200.

The food position information screen 260 and the food list information screen 300 may be disposed at the left and right sides, or at the upper and lower sides. The food position information screen 260 may be displayed in a refrigerator shape. That is, a refrigerator compartment 261, refrigerator compartment doors 262 and 263, a freezer compartment 264, and a switch compartment 265 may be displayed on the food position information screen 260. At least one storage space 266 for storing food may be displayed in each of the refrigerator compartment 261, the refrigerator compartment doors 262 and 263, the freezer compartment 264, and the switch compartment 265. At least one stored food as stored food information 270 for displaying stored food may be displayed in the storage space 266 of each of the refrigerator compartment 261, the refrigerator compartment doors 262 and 263, the freezer compartment 264, and the switch compartment 265.

A food category 301 and one or more foods as food display information 310 corresponding to the food category 301 may be displayed on the food list information screen 300.

Information for displaying stored food may be referred to as the stored food information 270, and information displayed on the food list information screen 300 may be referred to as the food display information 310. The stored food information 270 and the food display information 310 may be icons having the shapes of food. The stored food information 270 displayed on the food position information screen 260 may include the expiration dates thereof. The colors of stored foods as the stored food information 270 may be varied according to the expirations dates thereof. For example, when the expiration date is near, a food as the stored food information 270 may be red. When the expiration date is within 3 days, a food as the stored food information 270 may be orange. When the expiration date is within 5 days or more, a food as the stored food information 270 may be blue.

When a plurality of food categories are displayed on the food list information screen 300, change selection parts 302 and 303 for changing the food categories may be provided. The food categories may include at least one of frequently used food, meat, fish, a vegetable, a fruit, a dairy product, processed food, and a user-defined category. A user may add or rename a food category. The number and names of food categories are not limited within the scope of the present disclosure.

One or more of foods as the food display information 310 may be predefined in the other food categories except for the frequently used food and the user-defined category. For example, pork, beef, chicken, and sausage may be predefined in the meat. A plurality of foods as the food display information 310 defined in a specific food category may be arrayed in the left and right direction or the up and down direction.

A wastebasket 267 to which the stored food information 270 is removed from the food position information screen 260, and a voice input selection part 268 for inputting a voice may be displayed on the second screen 200.

Figure 15:
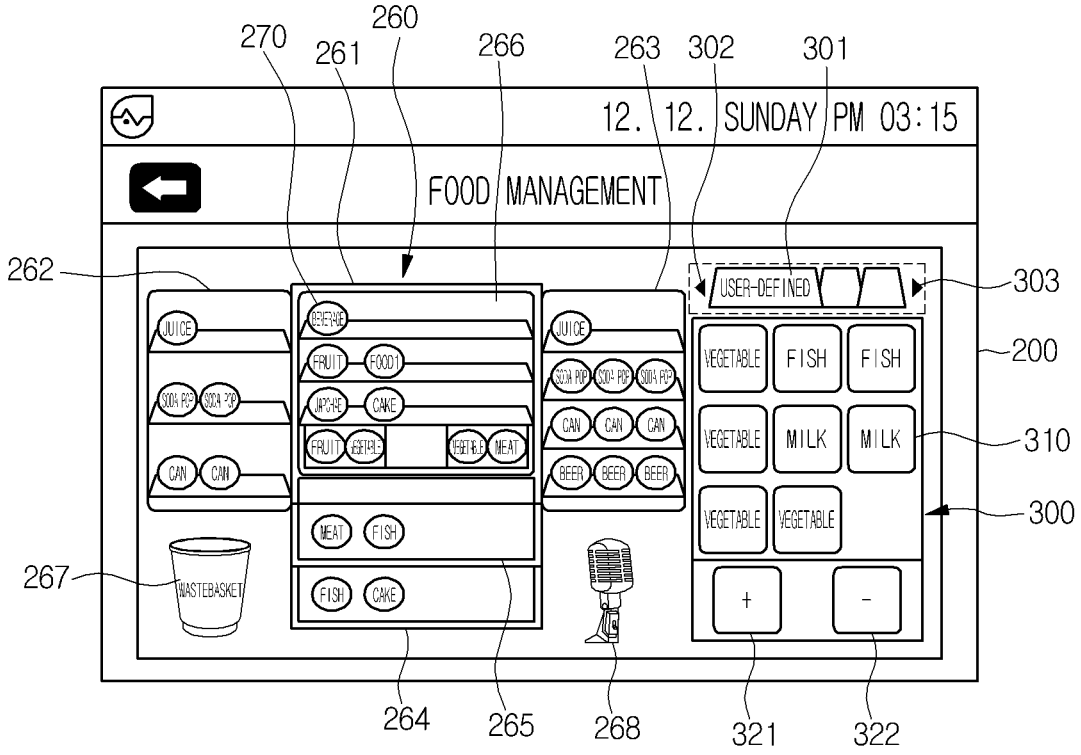
FIG. 15 is a view illustrating an example of a screen displayed when a user-defined category is selected on a food list information screen.

FIG. 15 is a view illustrating an example of a screen displayed when the user-defined category is selected on the food list information screen.

Referring to FIG. 15, when the user-defined category is selected (displayed) on the food list information screen 300, not only the food display information 310 and the food categories 301, but also an addition selection part 321 selected to add food and a deletion selection part 322 selected to delete added food may be displayed on the food list information screen 300. The addition selection part 321 may be selected to define an undefined food.

Figure 16:
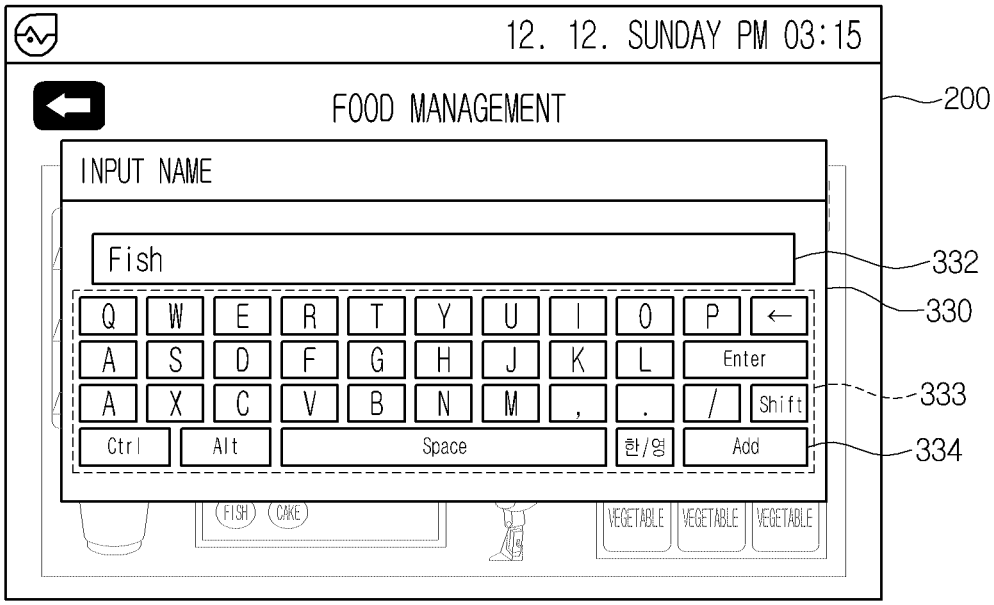
FIG. 16 is a view illustrating an example of a screen displayed when an addition selection part is selected on the screen of FIG. 15.

FIG. 16 is a view illustrating an example of a screen displayed when the addition selection part is selected on the screen of FIG. 15.

Referring to FIGS. 15 and 16, when the addition selection part 321 is selected on the screen of FIG. 15, an input screen 330 for inputting food information may be displayed on the second screen 200. The input screen 330 may be popped up on the screen of FIG. 15.

An input part 333 for inputting a food name, and a name display part 332 on which the input food name is displayed may be displayed on the input screen 330. The input food name may be expressed in Korean or English, but the present disclosure is not limited thereto.

The input part 333 may include an addition part 334 that is selected after a food name is input.

Figure 17:
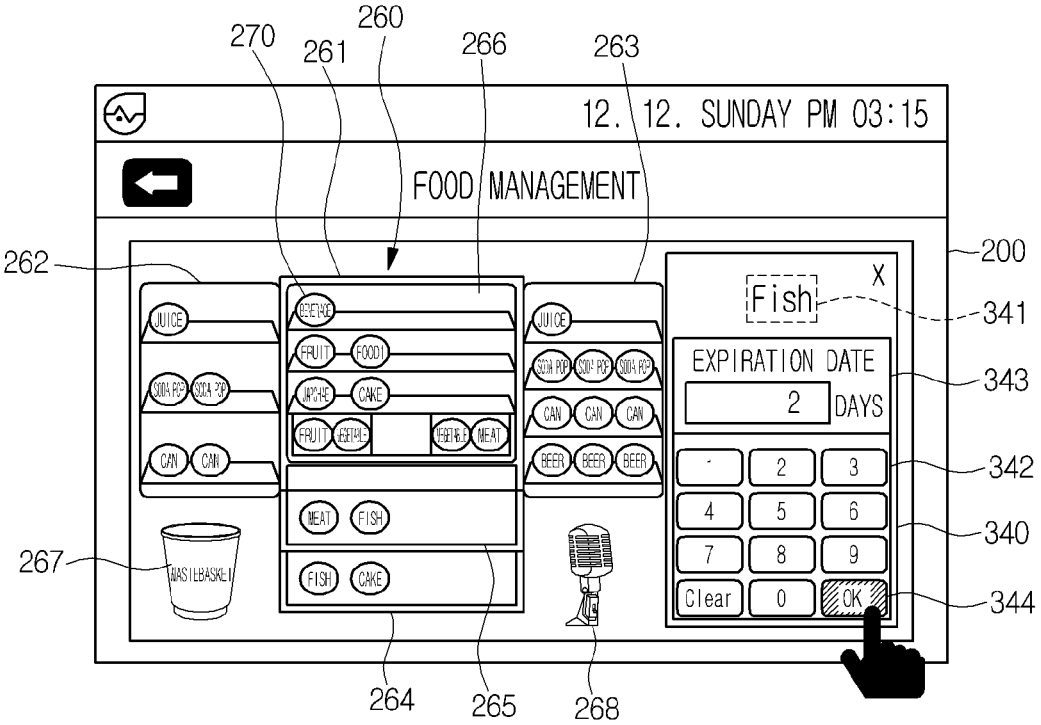
FIG. 17 is a view illustrating an example of a screen displayed when an addition part is selected on the screen of FIG. 16.

FIG. 17 is a view illustrating an example of a screen displayed when the addition part is selected on the screen of FIG. 16.

Referring to FIGS. 16 and 17, when the addition part 334 is selected on the screen of FIG. 16, an input screen 340 for inputting an expiration date may be displayed on the second screen 200. The input screen 340 for inputting an expiration date may be displayed in the position of the food list information screen 300. An input part 342 for inputting an input name 341 and an expiration date, and an expiration date display part 343 on which the input expiration date is displayed may be displayed on the input screen 340. The input part 342 may include a selection part 344 that is selected after an expiration date is input. The input expiration date may be time remaining from an input time (date).

The food display information 310 predefined in the other categories except for the user-defined category may include information about food names and expiration dates. That is, the expiration dates of foods predefined in the other categories except for the user-defined category are preset. The expiration dates of the foods predefined in the other categories except for the user-defined category cannot be modified on the food list information screen 300. For example, the expiration dates of foods predefined in the other categories except for the user-defined category cannot be modified on the food list information screen 300, and the expiration dates of foods displayed on the food position information screen 260 can be modified by a user.

Figure 18:
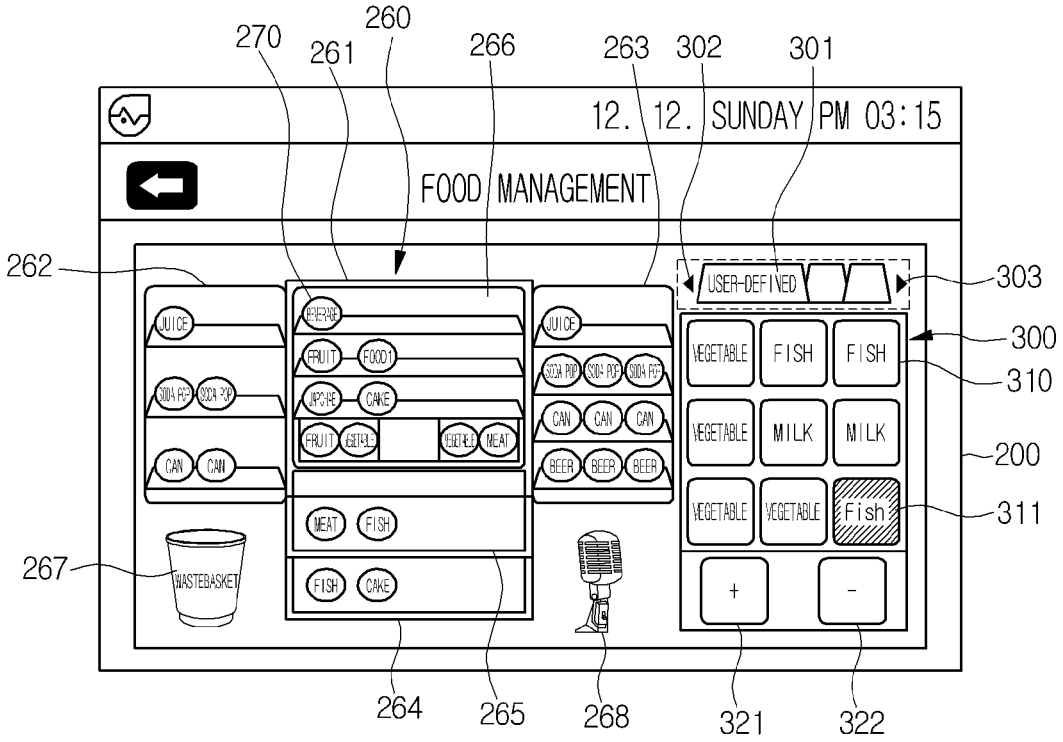
FIG. 18 is a view illustrating an example of a screen displayed after an expiration date is input on the screen of FIG. 17.

FIG. 18 is a view illustrating an example of a screen displayed after an expiration date is input on the screen of FIG. 17.

Referring to FIGS. 15 and 18, when the selection part 344 is selected on the screen of FIG. 17, added food display information 311 may be displayed on the food list information screen 300. For example, when eight items are added as the added food display information 311, the eight items may be displayed as the food display information 310 on the food list information screen 300 as illustrated in FIG. 15. After that, when a food is added by a user, nine items including the food display information 310 and the added food as the added food as the added food display information 311 may be displayed on the food list information screen 300 as illustrated in FIG. 18.

When the deletion selection part 322 is selected on the screen of FIG. 15 or 18 after selecting a specific item as the food display information 310 or the added food display information 311, the specific item may be deleted, that is, disappear from the food list information screen 300.

Figure 19:
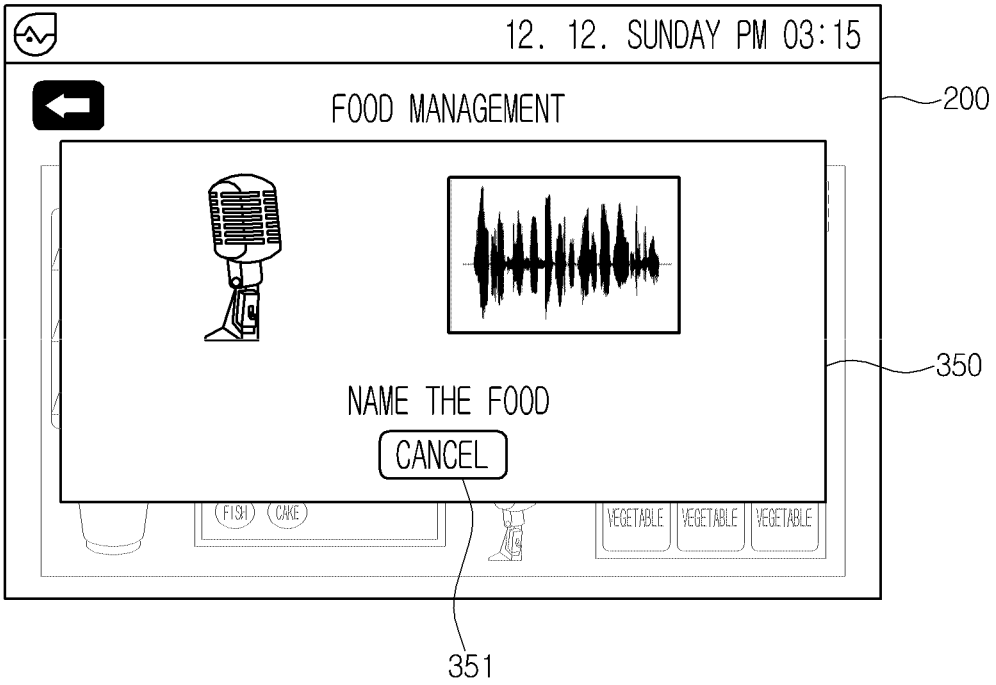
FIG. 19 is a view illustrating an example of a screen displayed when a voice input selection part is selected on the screen of FIG. 15 or 18.

FIG. 19 is a view illustrating an example of a screen displayed when the voice input selection part is selected on the screen of FIG. 15 or 18.

Referring to FIG. 19, when the voice input selection part 268 is selected on the screen of FIG. 15 or 18, a voice input screen 350 may be displayed on the second screen 220. Then, a user can input the name of a food with his/her voice. In this case, the refrigerator 1 includes a microphone (not shown) for inputting a voice.

A cancel selection part 351 may be displayed on the voice input screen 350 to cancel the input of a voice. When the cancel selection part 351 is selected, the screen of FIG. 19 may be changed to the screen of FIG. 15 or 18.

Figure 20:
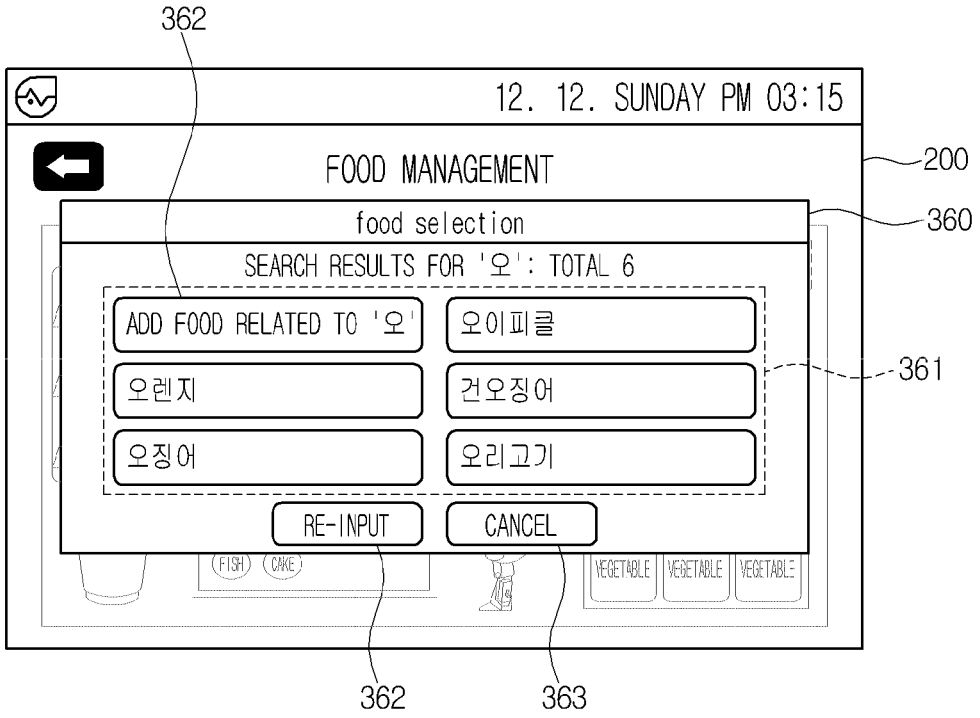
FIG. 20 is a view illustrating an example of a screen displayed when the input of a voice is completed on the screen of FIG. 19.

FIG. 20 is a view illustrating an example of a screen displayed when the input of a voice is completed on the screen of FIG. 19.

Referring to FIG. 20, when the input of a voice is completed on the screen of FIG. 19, an input result screen 360 may be displayed on the second screen 200. One or more names corresponding to the input voice may be displayed the input result screen 360. Although the name of a food except for the names of predefined foods is not stored in the memory part 14, the name of a food corresponding to an input voice may be additionally stored. For example, when a user inputs a syllable '오', food name information 361 including the syllable '오' may be displayed on the input result screen 360. A selection part 362 selected for inputting the name of an undisplayed food may be displayed the input result screen 360. When an item is selected from the food name information 361 displayed on the screen of FIG. 20, the screen of FIG. 20 may be changed to the screen of FIG. 17. When the selection part 362 is selected on the screen of FIG. 20, the screen of FIG. 20 may be changed to the screen of FIG. 16.

Figure 21:
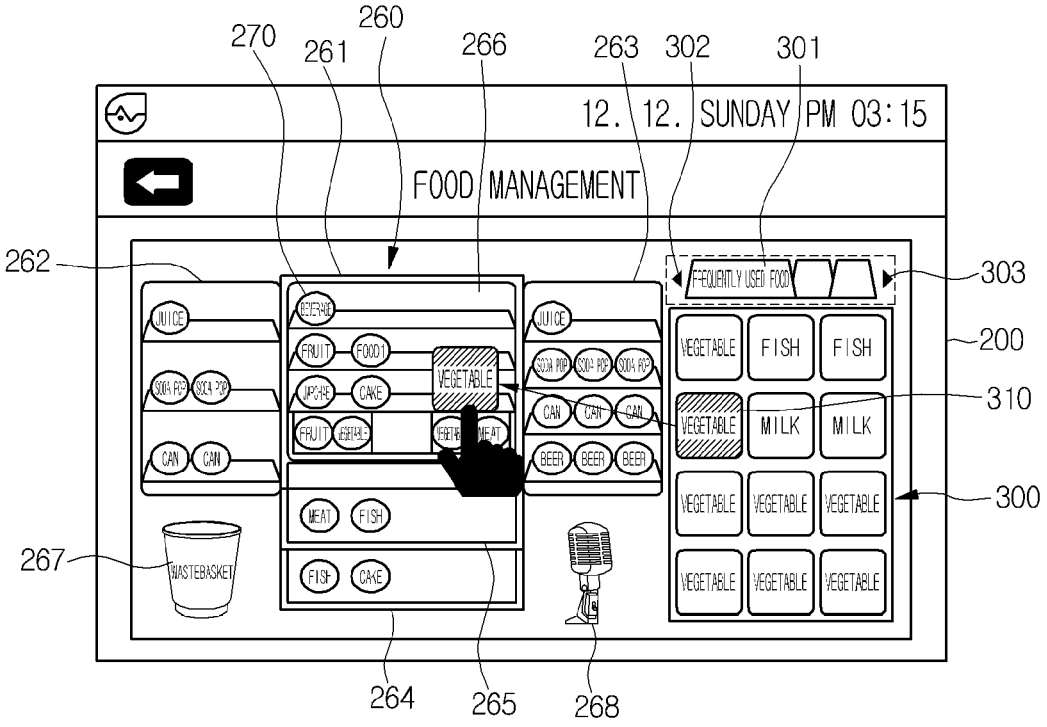
FIG. 21 is a view illustrating a method of moving a specific food displayed on a food list information screen to a food position information screen according to an embodiment.

FIG. 21 is a view illustrating a method of moving a specific food displayed on the food list information screen to the food position information screen according to an embodiment.

Referring to FIG. 21, a specific food is selected from the food display information 310 displayed on the food list information screen 300, and the selected food as the food display information 310 is dragged to a specific storage on the food position information screen 260, whereby the selected food can be added to the stored food information 270 in the specific storage. At this point, the selected food as the food display information 310 is not deleted on the food list information screen 300, and is just added to the stored food information 270 on the food position information screen 260.

Figure 22:
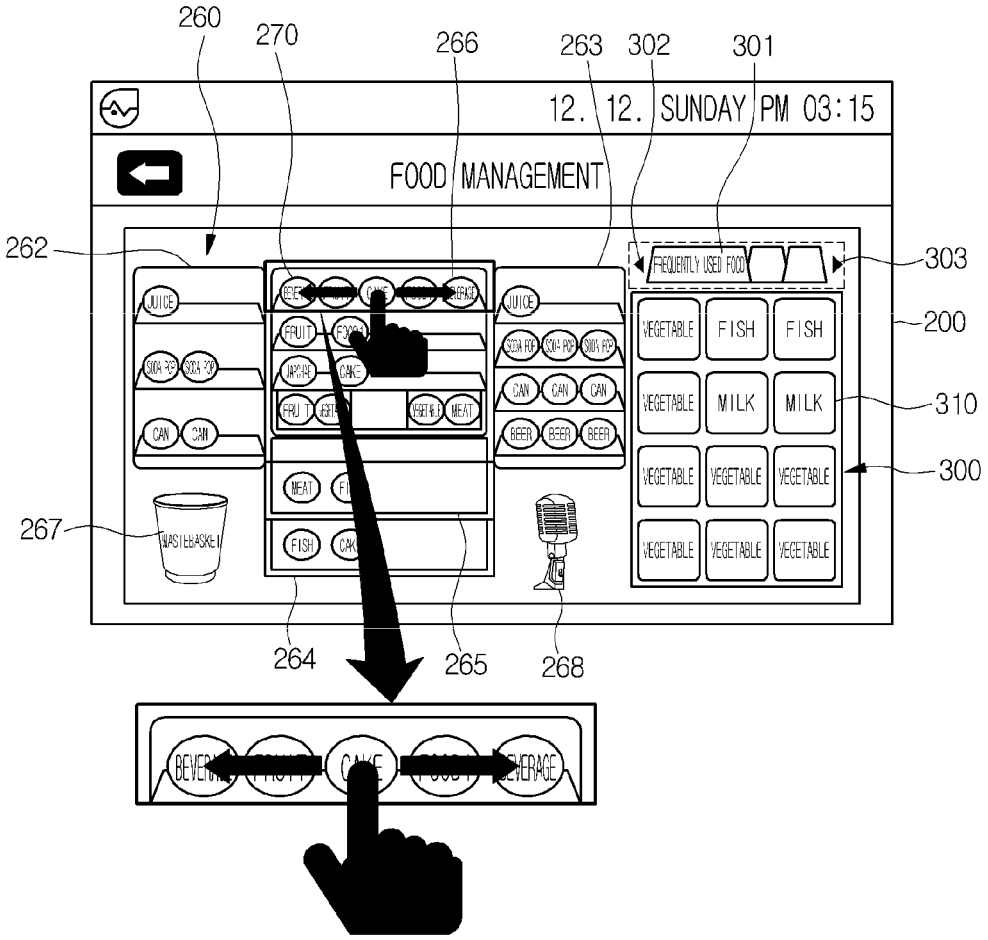
FIG. 22 is a view illustrating a method of checking information about a food stored in a specific storage on a food position information screen according to an embodiment.

FIG. 22 is a view illustrating a method of checking information about a food stored in a specific storage on the food position information screen according to an embodiment.

Referring to FIG. 22, when a region out of foods is selected in the refrigerator compartment 261 displayed on the food position information screen 260, the refrigerator compartment 261 may be expanded. In this state, when the stored food information 270 is selected and scrolled left and right, one or more foods of the stored food information 270 stored in the refrigerator compartment 261 can be checked. When a plurality of foods as the stored food information 270 are stored in the refrigerator compartment 261, a part of the stored foods may be displayed, or all of the foods may be displayed in a state of overlapping one another. In this case, it may be difficult to accurately check the foods stored in the refrigerator compartment 261. However, the refrigerator compartment 261 is expanded, and then, the stored food information 270 is selected and scrolled left and right, so that the stored foods can be accurately checked.

Figure 23:
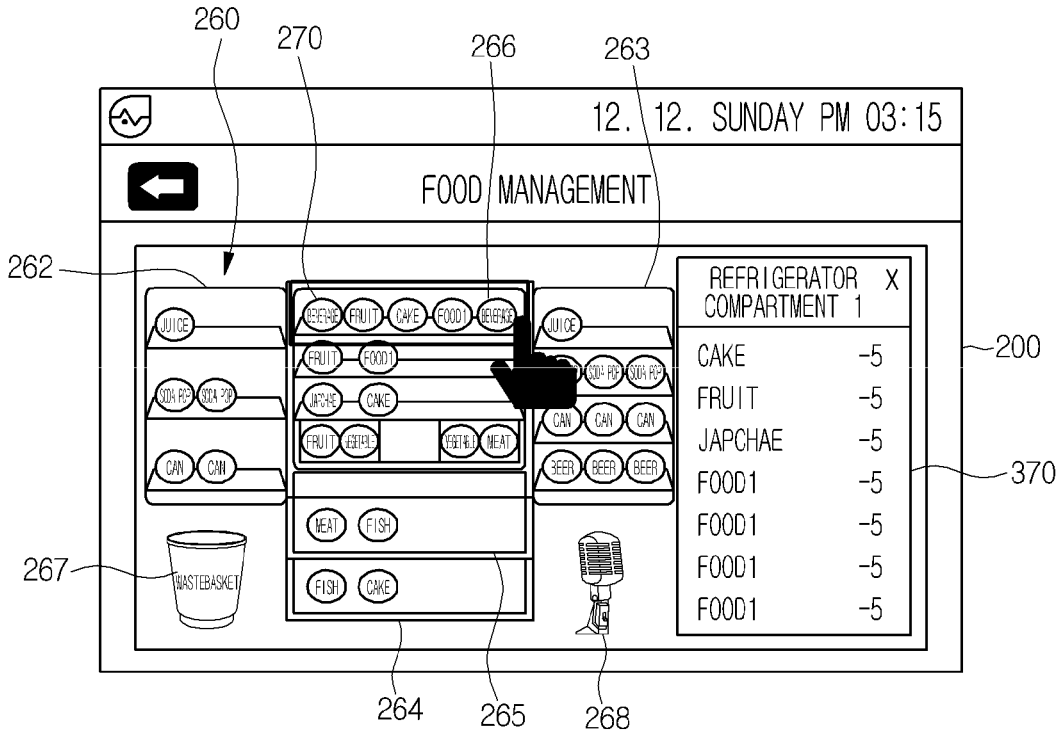
FIG. 23 is a view illustrating another method of checking information about a food stored in a specific storage on a food position information screen according to an embodiment.

FIG. 23 is a view illustrating another method of checking information about a food stored in a specific storage on the food position information screen according to an embodiment.

Referring to FIG. 23, when an edge of the refrigerator compartment 261 displayed on the food position information screen 260 is selected, a stored food list screen 370 of foods stored in the refrigerator compartment 261 may be displayed. The stored food list screen 370 may be displayed in a position corresponding to the food list information screen 300. Information displayed on the stored food list screen 370 may include the name of a stored food and an expiration date thereof.

Figure 24:
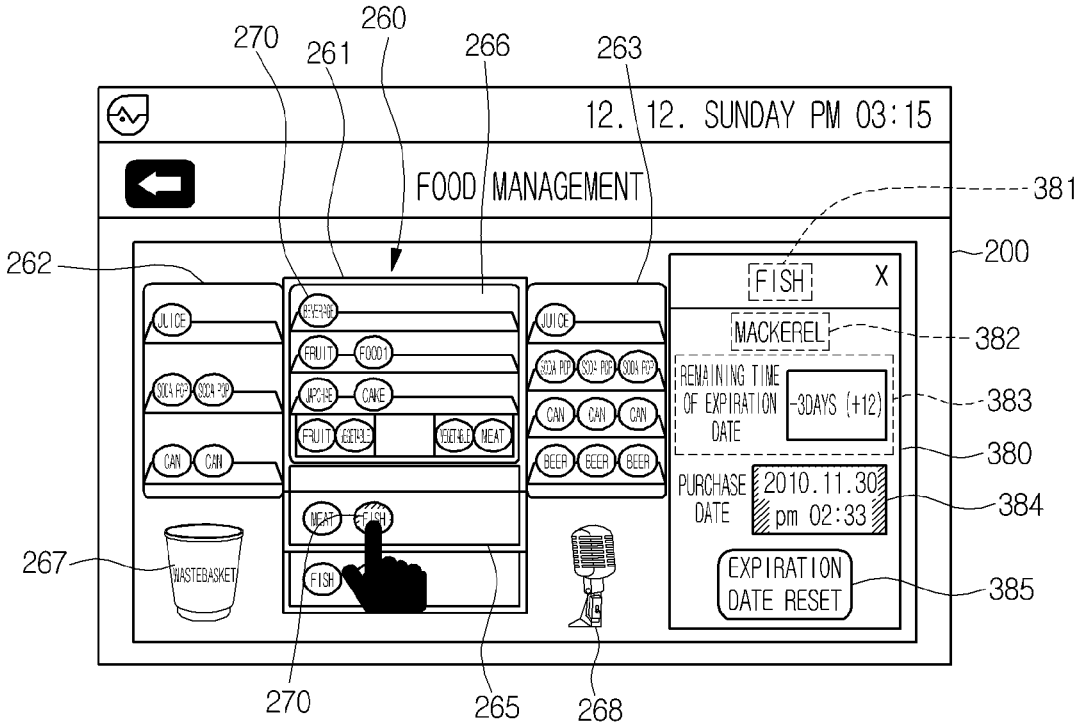
FIG. 24 is a view illustrating an example of a screen displayed when specific stored food information is selected on a food position information screen according to an embodiment.

FIG. 24 is a view illustrating an example of a screen displayed when specific stored food information is selected on the food position information screen according to an embodiment.

Referring to FIG. 24, when a specific food is selected from the stored food information 270 displayed on the food position information screen 260, a detailed information screen 380 corresponding to the selected food may be displayed on the second screen 200. The detailed information screen 380 may be displayed in a position corresponding to the food list information screen 300.

At least one of food category information 381, a food name 382, expiration date information 383, purchase date information 384, and an expiration date reset selection part 385 may be displayed on the detailed information screen 380. The expiration date information 383 may include remaining time of an expiration date, and time elapsed from a purchase date.

Figure 25:
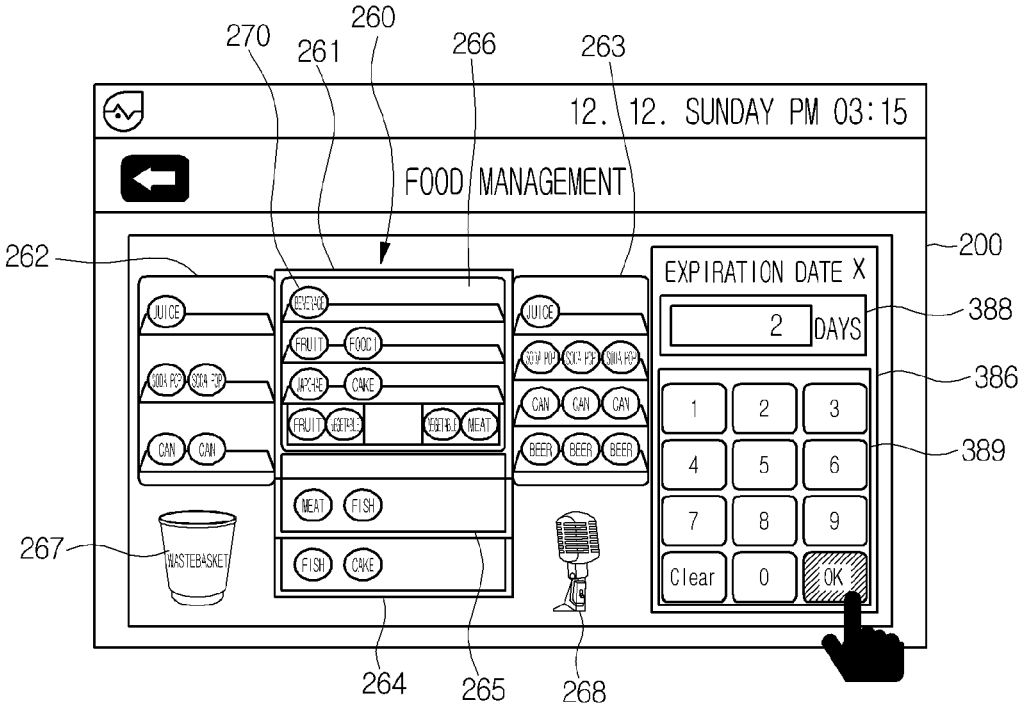
FIG. 25 is a view illustrating an example of a screen displayed when an expiration date reset selection part is selected on the screen of FIG. 24.

FIG. 25 is a view illustrating an example of a screen displayed when the expiration date reset selection part is selected on the screen of FIG. 24.

Referring to FIG. 25, when the expiration date reset selection part 385 is selected on the screen of FIG. 24, an input screen 386 for inputting an expiration date may be displayed on the second screen 200. The input screen 386 for inputting an expiration date may be displayed in the position of the food list information screen 300. An input part 387 for inputting an expiration date, and an expiration date display part 388 on which the input expiration date is displayed may be displayed on the input screen 386. The input part 387 may include a selection part 389 that is selected after an expiration date is input. The input expiration date may be time remaining from an input time (date). For example, when the selection part 389 is selected, the screen of FIG. 25 may be changed to the screen of FIG. 14 or 24.

Figure 26:
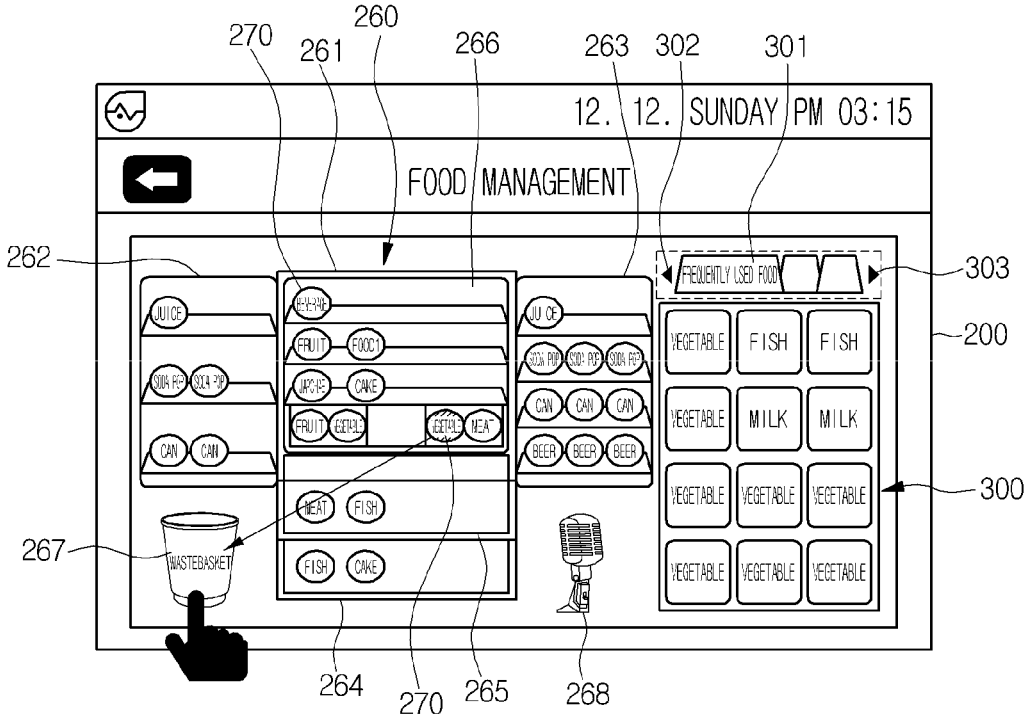
FIG. 26 is a view illustrating a method of deleting stored food information from a food position information screen according to an embodiment.

FIG. 26 is a view illustrating a method of deleting stored food information from the food position information screen according to an embodiment.

Referring to FIG. 26, when a specific food is selected from the stored food information 270 displayed on the food position information screen 260, and is dragged to the wastebasket 267, the selected food disappears (that is, is deleted from the stored food information 270).

Figure 27:
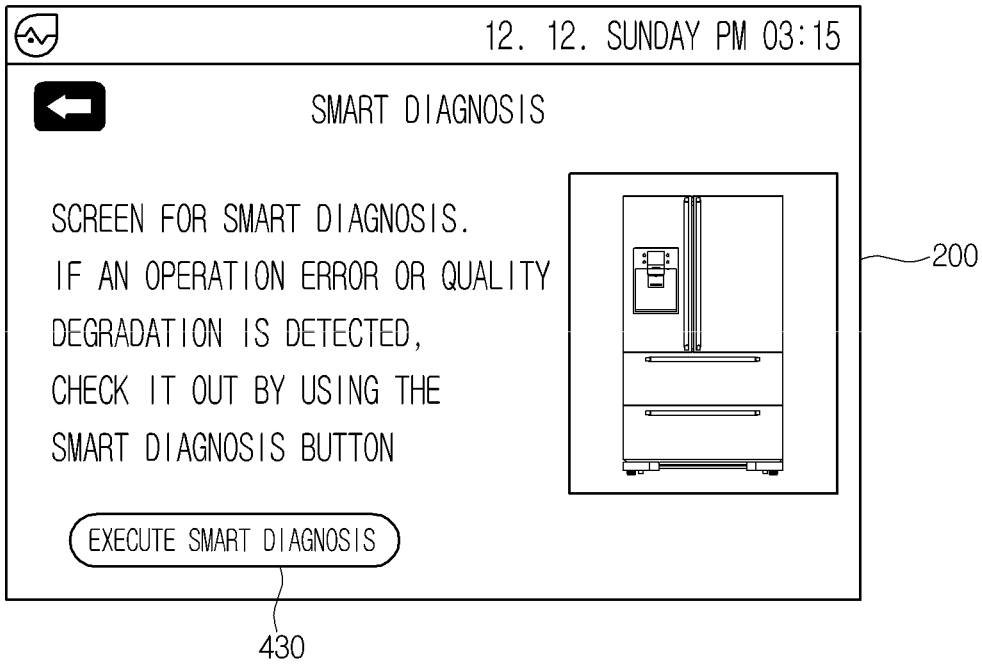
FIG. 27 is a view illustrating an example of a screen displayed when a smart diagnosis selection part is selected on the screen of FIG. 3 or 4.

FIG. 27 is a view illustrating an example of a screen displayed when the smart diagnosis selection part is selected on the screen of FIG. 3 or 4.

Referring to FIGS. 3, 4 and 27, when the smart diagnosis selection part 413 is selected on the screen of FIG. 3 or 4, smart diagnosis information and a smart diagnosis execution selection part 430 are displayed on the second screen 200.

Figure 28:
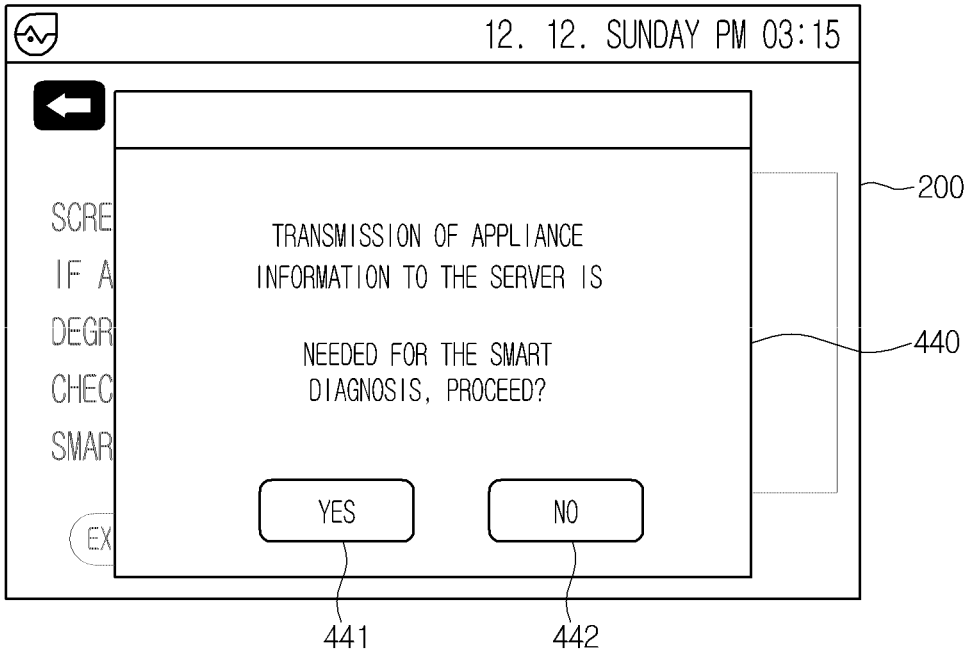
FIG. 28 is a view illustrating an example of a screen displayed when a smart diagnosis execution selection part is selected on the screen of FIG. 27.

FIG. 28 is a view illustrating an example of a screen displayed when the smart diagnosis execution selection part is selected on the screen of FIG. 27.

Referring to FIGS. 27 and 28, when the smart diagnosis execution selection part 430 is selected on the screen of FIG. 27, an information transmission confirmation screen 440 may be displayed. A first selection part 441 that is selected for transmitting information, and a second selection part 442 that is selected for cancelling the transmission of information may be displayed on the information transmission confirmation screen 440. When the second selection part 442 is selected, a previous screen (the screen of FIG. 27) or the screen of FIG. 3 may be displayed again.

Figure 29:
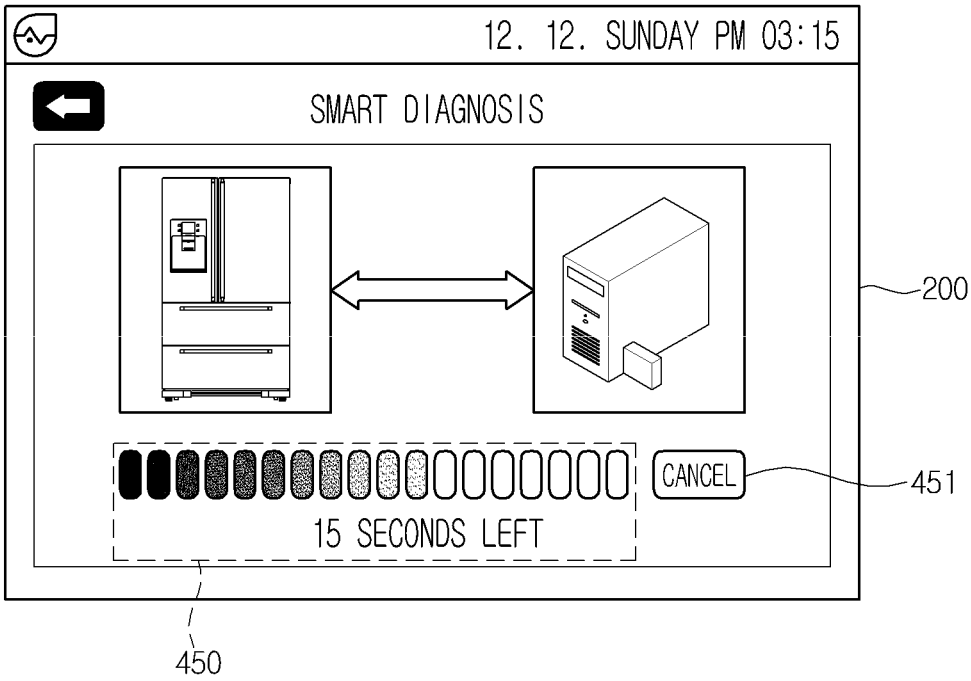
FIG. 29 is a view illustrating an example of a screen displayed when a selection part for information transmission is selected on the screen of FIG. 28.

FIG. 29 is a view illustrating an example of a screen displayed when the first selection part is selected on the screen of FIG. 28.

Referring to FIGS. 28 and 29, when the first selection part 441 is selected on the screen of FIG. 28, information transmission status information 450 and a cancel selection part 451 for cancelling the transmission of information may be displayed on the second screen 200.

The information transmission status information 450 may include at least one of level information for displaying information transmission status by degrees, and information about time remaining until the transmission is completed.

When the first selection part 441 is selected on the screen of FIG. 28, status information of the refrigerator 1 may be transmitted to the above-described server. For example, when the first selection part 441 is selected on the screen of FIG. 28, status information of the refrigerator 1 may be transmitted to the above-described communication component. An error of the refrigerator 1 may be diagnosed by the server or communication component.

Figure 30:
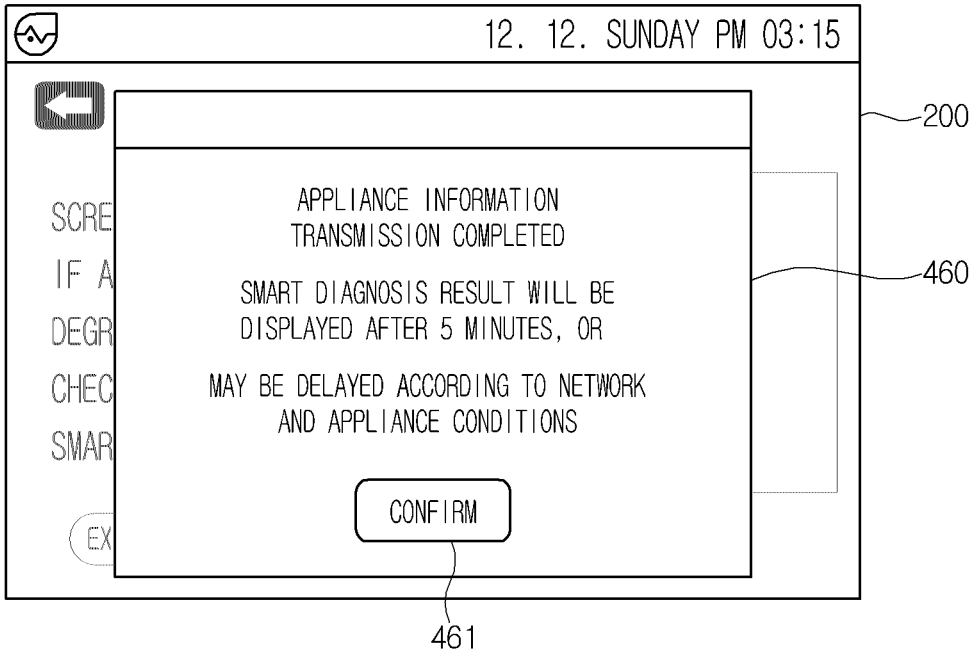
FIG. 30 is a view illustrating an example of a screen displayed when the transmission of information is completed on the screen of FIG. 29.

FIG. 30 is a view illustrating an example of a screen displayed when the transmission of information is completed on the screen of FIG. 29.

Referring to FIG. 30, when the transmission of information is completed on the screen of FIG. 29, an information transmission completion screen 460 may be displayed on the second screen 200. Information about time required for checking a diagnosis result may be displayed on the information transmission completion screen 460. A confirmation selection part 461 may be displayed on the information transmission completion screen 460. When the confirmation selection part 461 is selected, the screen of FIG. 30 may be changed to the screen of FIG. 3.

When a diagnosis is completed, diagnosis result information (not shown) may be displayed on the screen of FIG. 30.

Figure 31:
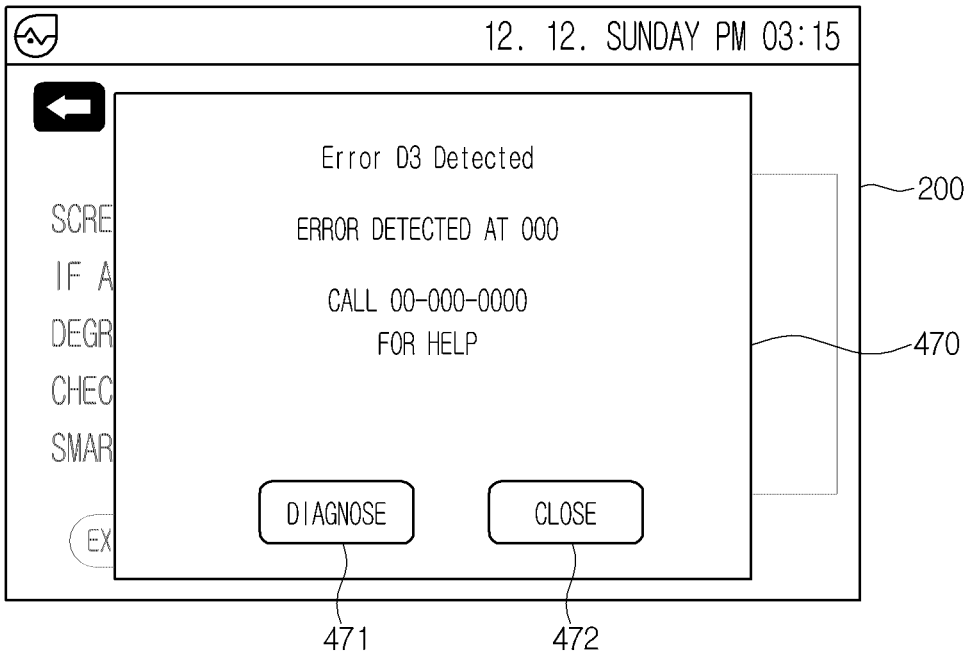
FIG. 31 is a view illustrating an example of a screen displayed when an error is detected during an operation of a refrigerator according to an embodiment.

FIG. 31 is a view illustrating an example of a screen displayed when an error is detected during an operation of the refrigerator according to an embodiment.

Referring to FIG. 31, when an error is detected during an operation of the refrigerator 1, an error notice screen 470 may be displayed on the second screen 200. Error information may be displayed on the error notice screen 470. A diagnosis selection part 471 and a closure selection part 472 for closing a current screen may be displayed on the error notice screen 470. When the diagnosis selection part 471 is selected, the processes described with reference to FIGS. 27 to 30 will be performed, and the screens of FIGS. 27 to 30 may be displayed. When the closure selection part 472 is selected, the screen of FIG. 31 may be changed to, e.g., the screen of FIG. 3.

As such, an error of the refrigerator 1 is diagnosed, and a diagnosis result is displayed, and thus, a user can easily check an error of the refrigerator 1.

Figure 32:
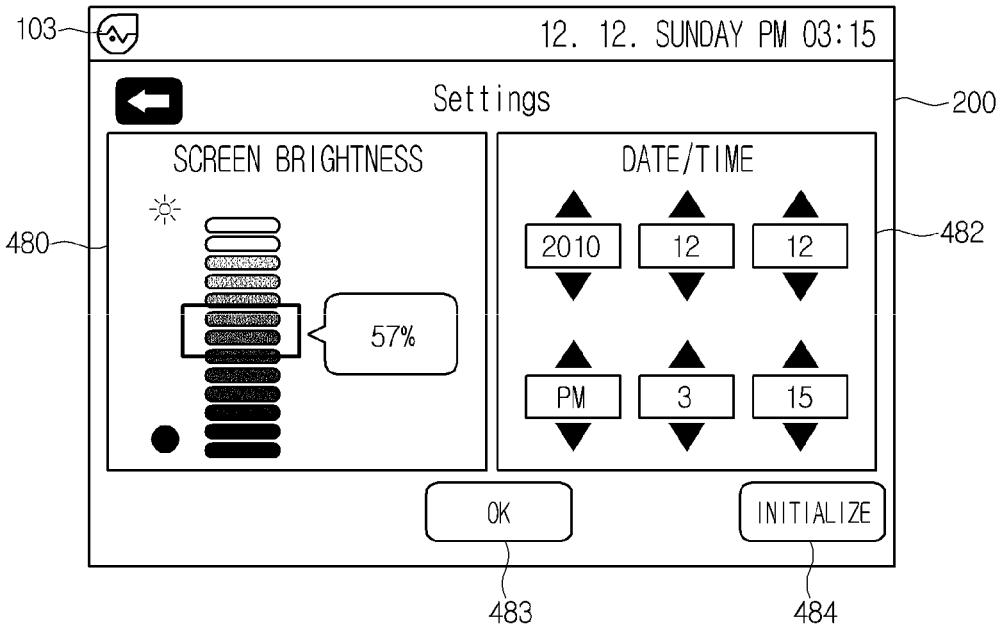
FIG. 32 is a view illustrating an example of a screen displayed when a set selection part is selected on the screen of FIG. 3.

FIG. 32 is a view illustrating an example of a screen displayed when the set selection part is selected on the screen of FIG. 3.

Referring to FIGS. 3 and 32, when the set selection part 414 is selected on the screen of FIG. 3, a screen brightness input screen 480, a date information input screen 482, and a storage selection part 483 selected after screen brightness or date information is input may be displayed on the second screen 200. Brightness levels on the screen brightness input screen 480 may be scrolled to adjust screen brightness. Level information and numerical information denoting screen brightness may be displayed on the screen brightness input screen 480. A date and time may be input (adjusted) on the date information input screen 482. An initialization selection part 484 may be displayed on the second screen 200. When the initialization selection part 484 is selected, the screen brightness may be set to, e.g., about 50%.

The display forms of the above described information are just examples, and thus, the present disclosure is not limited thereto.

Figure 33:
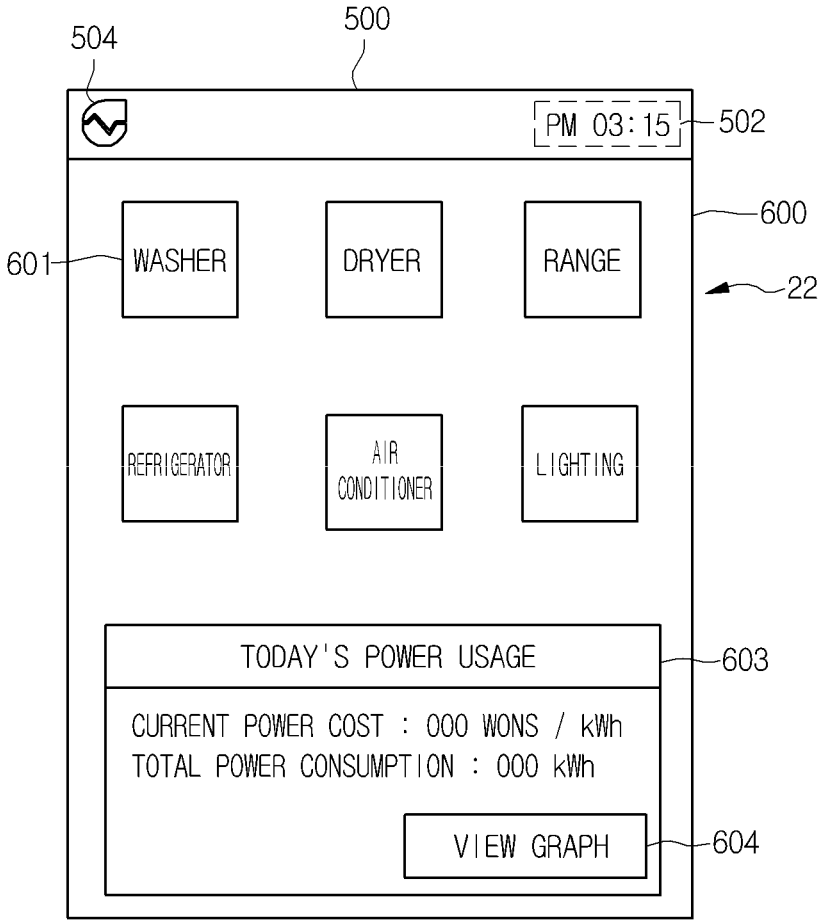
FIG. 33 is a view illustrating a display part of a communication component according to an embodiment.

FIG. 33 is a view illustrating the display part of the communication component according to an embodiment.

Referring to FIG. 33, a screen displayed on the display part 22 of the communication component 2 may include a first screen 500 and a second screen 600. The display part 22 may include a first user interface (UI) for remote control, and one or more second user interfaces (UIs) for performing other functions than the remote control. When the first user interface is activated, the screen of FIG. 33 may be displayed. In this case, the first user interface may be, e.g., an application for controlling a component.

For example, the first and second screens 500 and 600 may be vertically or horizontally arrayed. The first and second screens 500 and 600 may be independent screens, or be separated by displayed contents.

Time information 502 and smart grid function on/off information 504 may be displayed on the first screen 500. Further, date information may be displayed on the first screen 500. The smart grid function on/off information 504 may be varied according to on/off states. For example, the displayed smart grid function information may be varied in color, brightness, and chroma according to on/off states.

When the smart grid function is turned on, the communication component 2 may be operated based on energy information. That is, the communication component 2 may display the energy information, or transmit the energy information to the refrigerator 1.

At least one of power usage information and one or more component selection parts 601 for selecting a control target component may be displayed on the second screen 600. For example, as illustrated in FIG. 33, one or more of the component selection parts 601, and a power-related information screen 603 including power-related information may be displayed on the second screen 600.

The number of the component selection parts 601 displayed on the second screen 600 may be equal to the number of control target components registered in the communication component 2.

Current power cost information and total power consumption information may be displayed on the power-related information screen 603. A graph view selection part 604 (also called a detailed check selection part) for additionally checking detailed information may be displayed on the power-related information screen 603.

Figure 34:
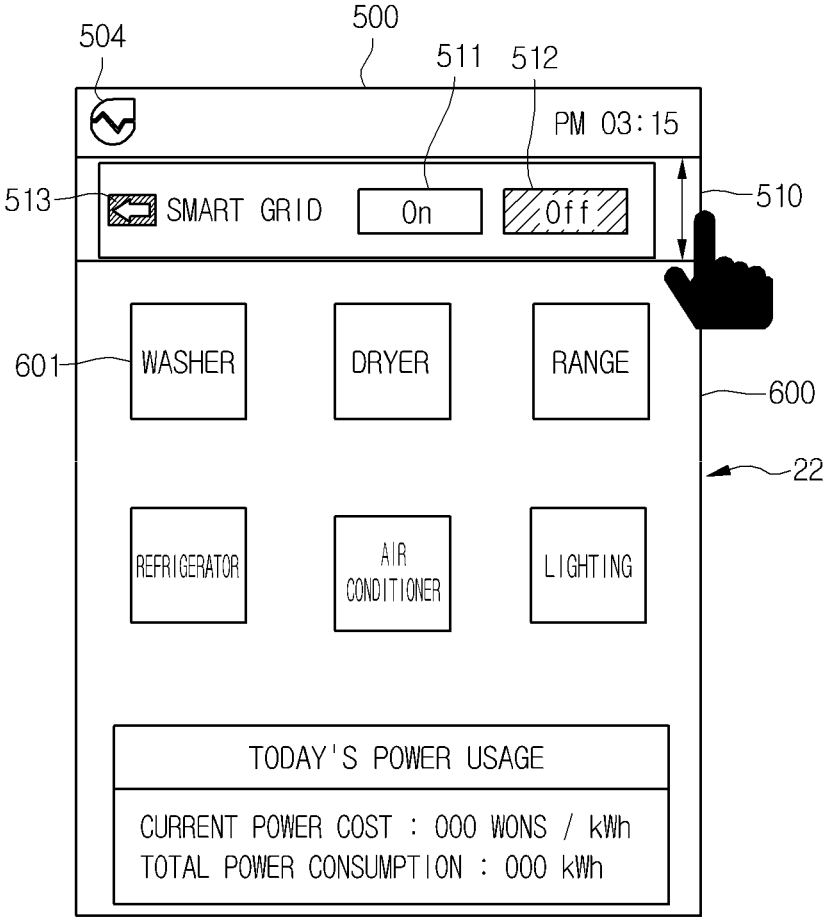
FIG. 34 is a view illustrating an example of a screen for selecting the on/off states of a smart grid function according to an embodiment.

FIG. 34 is a view illustrating an example of a screen for selecting the on/off states of the smart grid function according to an embodiment.

Referring to FIG. 34, when the boundary between the first and second screens 500 and 600, or the upper portion of the second screen 600 is touched and pulled down on the screen of FIG. 33, a smart grid information screen 510 may be displayed. An ON selection part 511 and an OFF selection part 512 may be displayed on the smart grid information screen 510. When the ON selection part 511 is selected, the smart grid function is turned on. When the OFF selection part 512 is selected, the smart grid function is turned off.

Alternatively, a single selection part may be displayed on the smart grid information screen 510. In this case, the smart grid function may be turned on or off according to the number of pressing the single selection part. A previous screen selection part 513 for a movement to the previous screen (of FIG. 33) may be displayed on the smart grid information screen 510. When the previous screen selection part 513 is selected, the smart grid information screen 510 disappears. Alternatively, when the smart grid information screen 510 is touched and moved upward, the smart grid information screen 510 may disappear. For example, when the smart grid function on/off information 504 is selected on the screen of FIG. 34, a pop up screen including an ON selection part and an OFF selection part, or a pop up screen including a single selection part may be displayed.

The smart grid information screen 510 may be a portion of the second screen 600 or a screen separated from the second screen 600.

Figure 35:
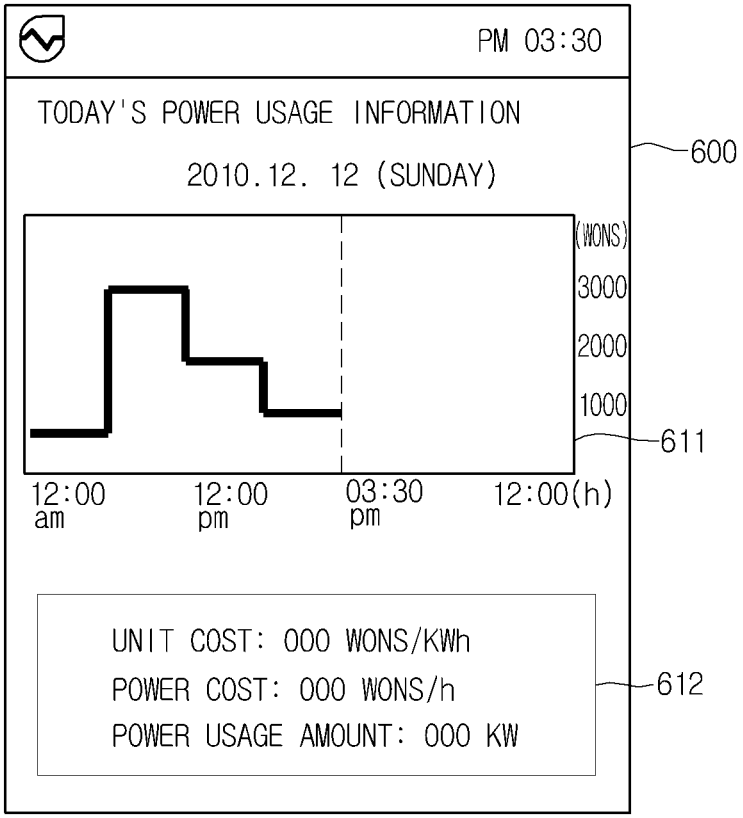
FIG. 35 is a view illustrating an example of a screen displayed when a graph view selection part is selected on the screen of FIG. 33.

FIG. 35 is a view illustrating an example of a screen displayed when the graph view selection part is selected on the screen of FIG. 33.

Referring to FIGS. 33 and 35, when the smart grid function is in the on state, and the graph view selection part 604 is selected on the screen of FIG. 33, power information screens 611 and 612 may be displayed on the second screen 600. The power information screens 611 and 612 may include at least one of a graph information screen 611 and a text information screen 612. Hourly power usage cost graph information (or power usage amount graph information) of today may be displayed on the graph information screen 611. For example, power usage cost graph information ranging from 12 A.M. to a present time may be displayed on the graph information screen 611. For example, when the current time is 3:30 P.M., usage amount graph information ranging from 12 A.M. to 3 P.M. may be displayed. At least one of unit power cost information, power usage cost information, and power usage amount information may be displayed on the text information screen 612.

The power information screens 611 and 612 may be displayed for a certain time on the second screen 600, and then, be changed to the screen of FIG. 33. Alternatively, when a previous screen selection part (not shown) is selected, the screen of FIG. 35 may be changed to the screen of FIG. 32.

Figure 36:
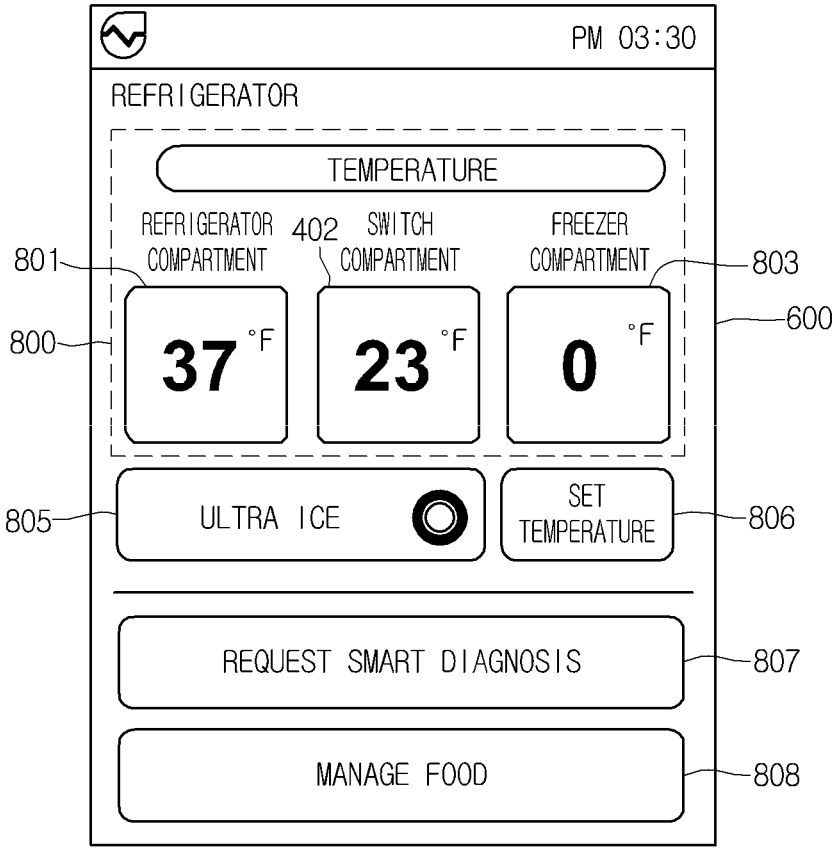
FIG. 36 is a view illustrating an example of a screen displayed when a specific component selection part is selected on the screen of FIG. 33.

FIG. 36 is a view illustrating an example of a screen displayed when a specific component selection part is selected on the screen of FIG. 33. In FIG. 36, a refrigerator is selected as a specific component.

Referring to FIGS. 33 and 36, when a specific component selection part (e.g., a washer selection part) is selected on the screen of FIG. 33, a temperature information screen 800 may be displayed on the second screen 600. The second screen 600 may display at least one of a quick ice making selection part 805 selected for quickly making ice, a temperature set selection part 806 selected for setting a temperature, a smart diagnosis request selection part 807 selected for requesting a diagnosis; and a food management selection part 808 for checking a stored food.

A quick ice making function may be turned on or off according to the number of pressing the quick ice making selection part 805. When the quick ice making function is turned on, ice is quickly made in an ice maker (not shown), so that a large amount of ice can be made for a short time.

Refrigerator compartment temperature information 801, switch compartment temperature information 402, and freezer compartment temperature information 803 may be displayed on the temperature information screen 800.

Figure 37:
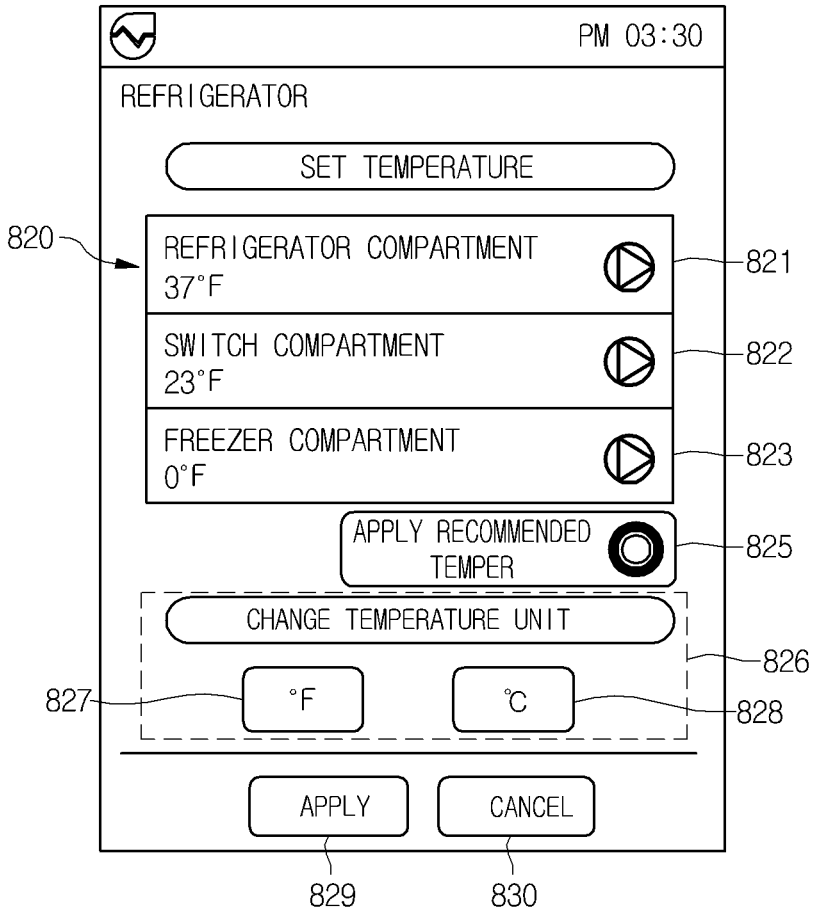
FIG. 37 is a view illustrating an example of a screen displayed when a temperature set selection part is selected on the screen of FIG. 36.

FIG. 37 is a view illustrating an example of a screen displayed when the temperature set selection part is selected on the screen of FIG. 36.

Referring to FIGS. 36 and 37, when the temperature set selection part 806 is selected on the screen of FIG. 36, a temperature input screen 820 may be displayed on the second screen 600. Further, the second screen 600 may display at least one of a recommended temperature selection part 825, a temperature unit change part 826, a first selection part 829 selected for storing set information, and a second selection part 830 selected for cancelling the setting of a temperature.

The temperature input screen 820 may display a refrigerator compartment temperature input part 821, a switch compartment temperature input part 822, and a freezer compartment temperature input part 823.

When the recommended temperature selection part 825 is selected, an optimum temperature may be determined based on current state information or power cost information of the refrigerator 1, and an automatic temperature setting operation may be performed. For example, in a state where a refrigerator compartment temperature, a switch compartment temperature, and a freezer compartment temperature are set to specific temperatures, respectively, when the recommended temperature selection part 825 is selected, the refrigerator compartment temperature, the switch compartment temperature, and the freezer compartment temperature may be automatically set to other specific values.

The temperature unit change part 826 may include a Fahrenheit selection part 827 for selecting Fahrenheit (° F.), and a Celsius selection part 828 for selecting Celsius (° C.). Alternatively, the temperature unit change part 826 may include a single selection part, and Fahrenheit or Celsius may be selected according to the number of pressing the single selection part.

Figure 38:
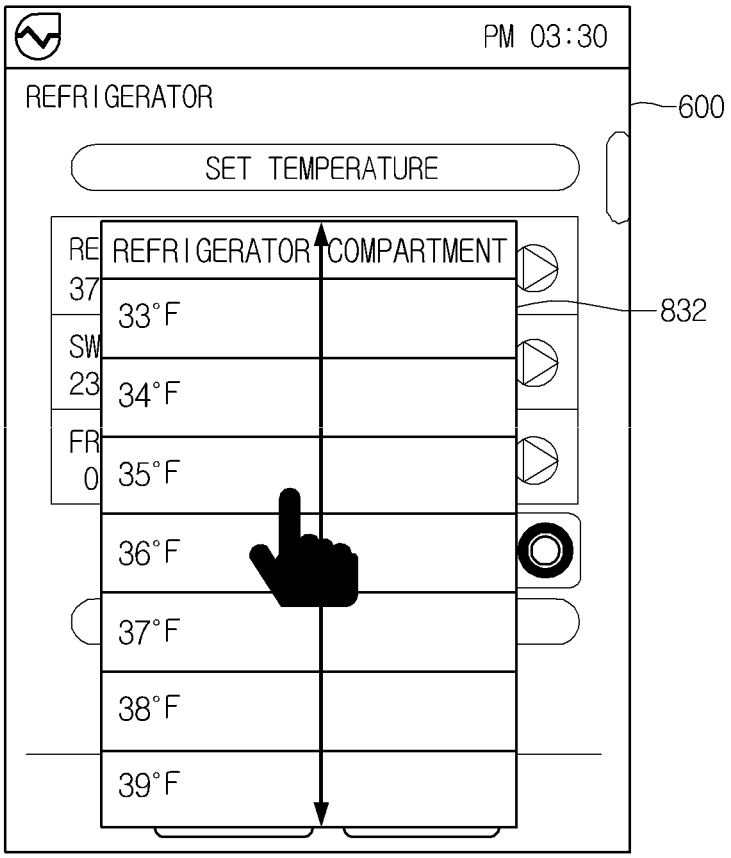
FIG. 38 is a view illustrating an example of a screen displayed when a temperature input part of a specific storage is selected on the screen of FIG. 37.

FIG. 38 is a view illustrating an example of a screen displayed when a temperature input part of a specific storage is selected on the screen of FIG. 37. In FIG. 38, the refrigerator compartment temperature input part is selected.

Referring to FIG. 38, when the refrigerator compartment temperature input part 821 is selected on the screen of FIG. 37, a detailed temperature selection part 832 for selecting a temperature may be displayed on the second screen 600. The detailed temperature selection part 832 may be popped up on the screen of FIG. 37. The detailed temperature selection part 832 may be used to select temperatures varied by one degree (Fahrenheit or Celsius). In the current embodiment, a temperature degree range for selecting a temperature may vary. For example, the detailed temperature selection part 832 may be used to select temperatures varied by two or greater degrees.

Figure 39:
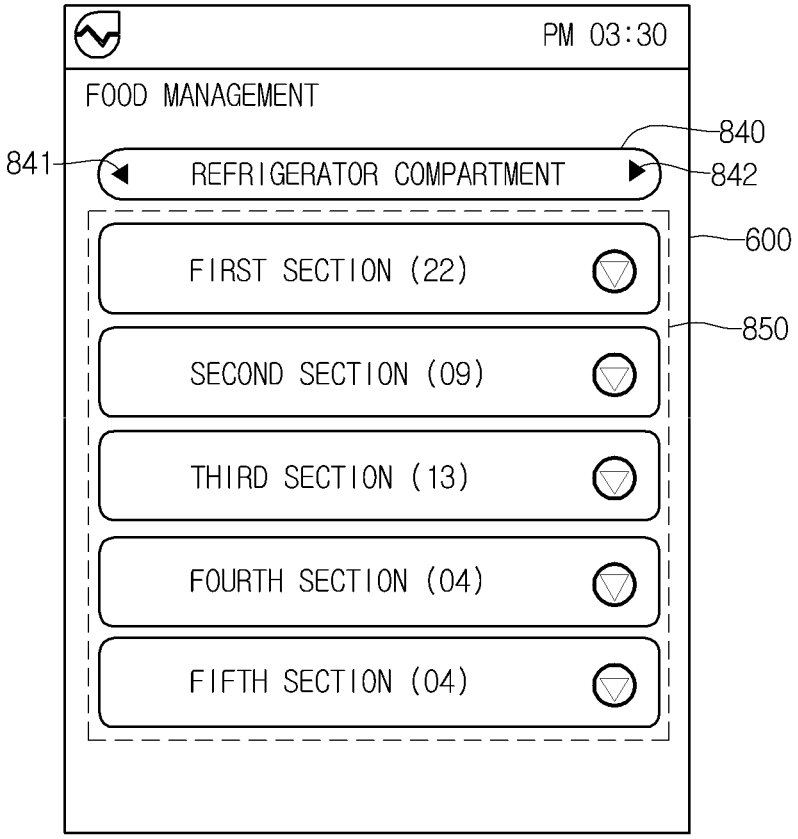
FIG. 39 is a view illustrating an example of a screen displayed when a food management selection part is selected on the screen of FIG. 36.

FIG. 39 is a view illustrating an example of a screen displayed when the food management selection part is selected on the screen of FIG. 36.

Referring to FIGS. 36 and 39, when the food management selection part 808 is selected on the screen of FIG. 36, a refrigerator compartment information screen 840 and a storing space information screen 850 for storing spaces disposed in the refrigerator compartment 261 may be displayed on the second screen 600. For example, when a refrigerator compartment is divided into five storing spaces, information about the five storing spaces may be displayed on the storing space information screen 850. The information about each storing space may include position information and the number of stored foods.

The refrigerator compartment information screen 840 may display movement selection parts 841 and 842 for selecting an information screen of another storage. Since a freezer compartment is also divided into a plurality of storing spaces, a screen configuration for displaying information about the freezer compartment is the same as that of a refrigerator compartment. Thus, a description thereof will be omitted.

Figure 40:
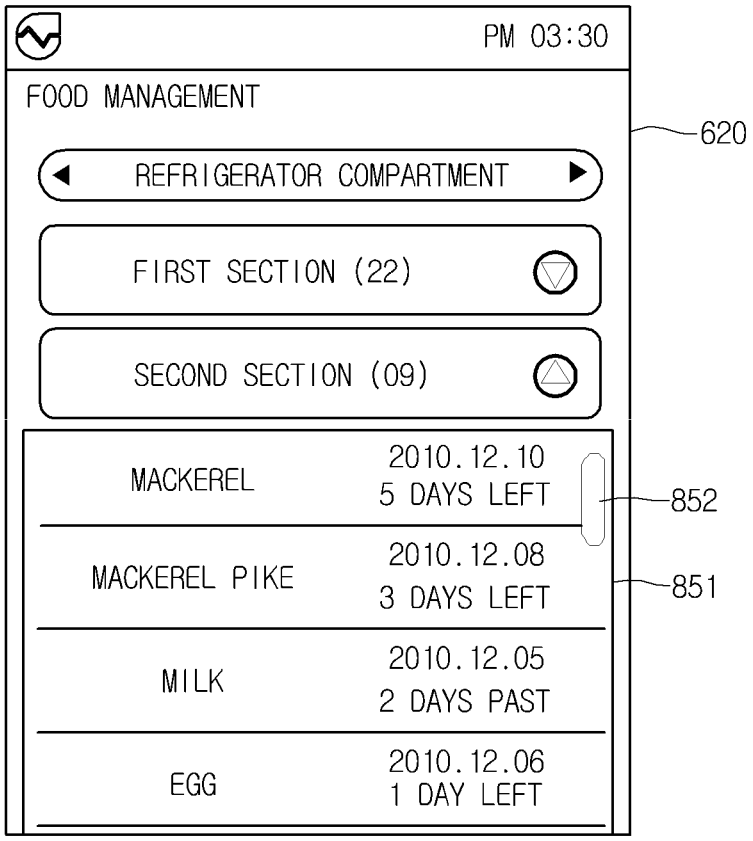
FIG. 40 is a view illustrating an example of a screen displayed when a specific storing space is selected on the screen of FIG. 39.

FIG. 40 is a view illustrating an example of a screen displayed when a specific storing space is selected on the screen of FIG. 39.

Referring to FIGS. 39 and 40, when a specific storing space (e.g., a second section) is selected on the storing space information screen 850 of FIG. 39, a food information screen 851 corresponding to foods stored in the selected storing space may be displayed. The food information screen 851 may include the names of the stored foods and the expiration dates thereof. Further, the food information screen 851 may include the dates when the foods have been stored.

When a part of the foods stored in the food information screen 851 is displayed, the food information screen 851 may further display a scroll bar 852 for checking the undisplayed foods.

Figure 41:
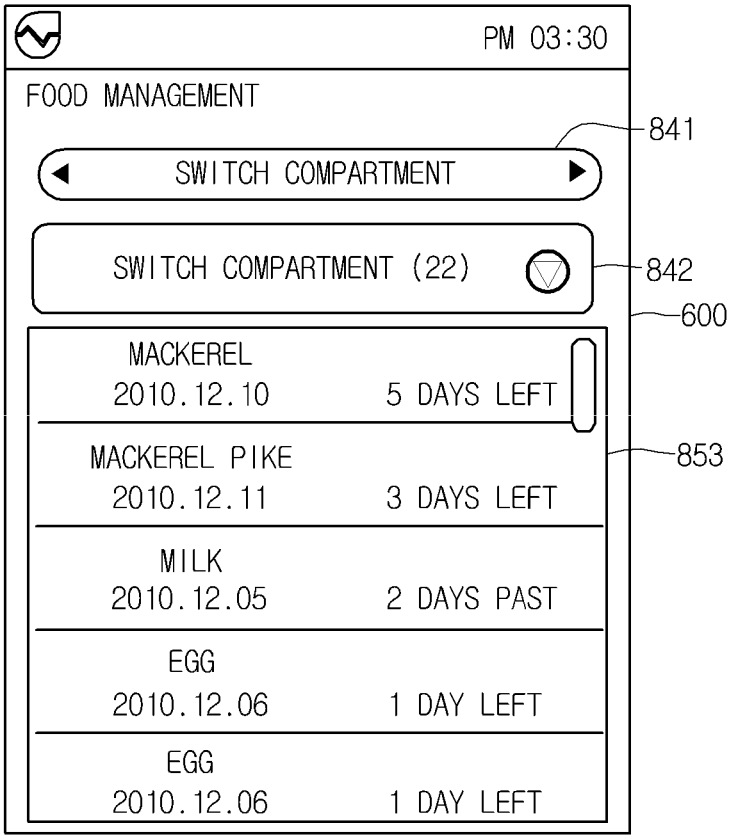
FIG. 41 is a view illustrating an example of a screen displayed when a movement selection part is selected on the screen of FIG. 39 or 40.

FIG. 41 is a view illustrating an example of a screen displayed when the movement selection part is selected on the screen of FIG. 39 or 40.

Referring to FIGS. 39 to 41, when the movement selection part 841 or 842 is selected on the screen of FIG. 39 or 40, a switch compartment information screen 841', a storing space information screen 842', and a food information screen 853 may be displayed on the second screen 600. When a switch compartment has a single storing space, the food information screen 853 may be displayed together with the switch compartment information screen 841' and the storing space information screen 842'. When a switch compartment is divided into a plurality of storing spaces, a screen configuration for displaying information about the switch compartment may be the same as that of a freezer compartment.

Although the information about the refrigerator compartment is displayed when the food management selection part 808 is selected on the screen of FIG. 36, information about the switch compartment or the freezer compartment may be displayed.

Figure 42:
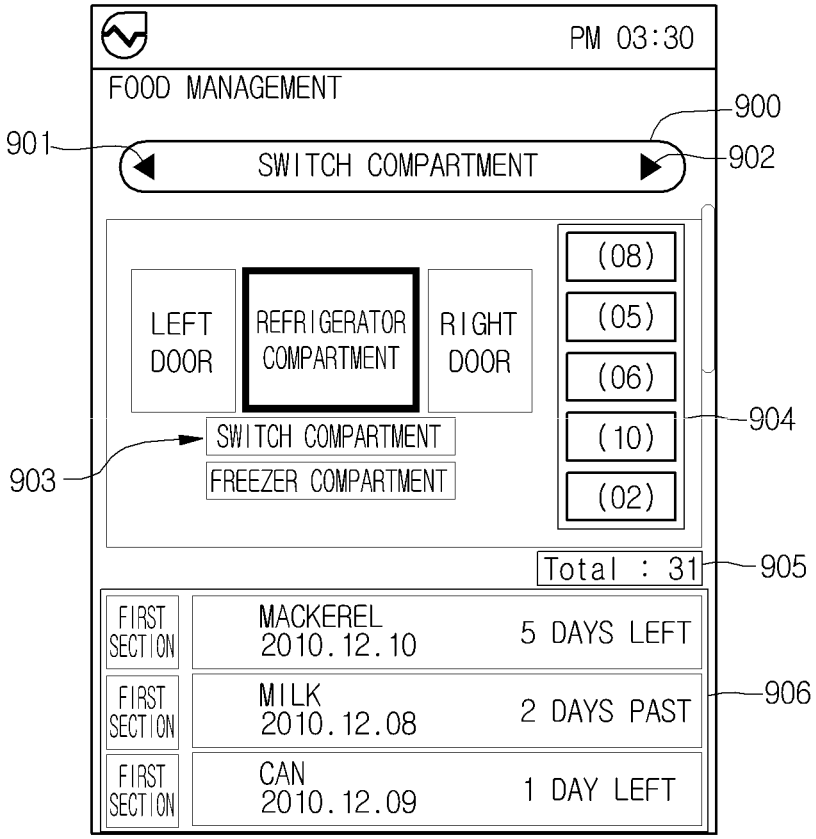
FIG. 42 is a view illustrating another example of a screen displayed when the food management selection part is selected on the screen of FIG. 36.

FIG. 42 is a view illustrating another example of a screen displayed when the food management selection part is selected on the screen of FIG. 36.

Referring to FIGS. 36 and 42, when the food management selection part 808 is selected on the screen of FIG. 36, at least one of a storage information screen 900 and a storage position information screen 903 may be displayed on the second screen 600. Further, a storing space information screen 904 may be displayed on the second screen 600. In addition, at least one of total number information 905 of foods stored in a specific storage, and a food information screen 906 corresponding to the specific storage may be displayed on the second screen 600.

Information about one of a refrigerator compartment, a switch compartment, and a freezer compartment may be displayed on the storage information screen 900. Movement selection parts 901 and 902 may be displayed on the storage information screen 900 to check a storage except for a currently displayed storage (e.g., a refrigerator compartment).

For example, the storage position information screen 903 may be displayed in a refrigerator shape. The position of the storage displayed on the storage information screen 900 may be displayed on the storage position information screen 903. Thus, a user can easily check the position of the currently displayed storage.

When the storage is divided into five storing spaces, information about the five storing spaces may be displayed on the storing space information screen 904. The information about each storing space may include the number of stored foods.

Information about at least one part of foods stored in a specific storing space may be displayed on the food information screen 906. In this case, the information about the stored foods may include the names and the expiration dates thereof. Further, the information about the stored foods may include the dates when the foods have been stored.

According to the embodiments, since information about a food stored in the refrigerator can be displayed on the communication component, a user can check the information about the food stored in the refrigerator, without opening a door of the refrigerator.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a display part for displaying information; and a control part for controlling the display part, wherein the display part comprises a first display part for displaying information related to an additional function except for a cooling function, and a second display part for displaying temperature information related to the cooling function, wherein the first display part displays a plurality of screens, the screens comprise a first screen and a second screen, the first screen displays smart grid function on/off information of a smart grid function, and the smart grid function on/off information is displayed differently according to an on state and an off state of the smart grid function.

2. The refrigerator according to claim 1, further comprising a communication module communicating with an external communication component, wherein the first display part displays information received from an outside.

3. The refrigerator according to claim 1, wherein the first screen further displays at least one of date information or time information, and the second screen displays one or more selection parts for selecting the additional function.

4. The refrigerator according to claim 3, wherein the one or more selection parts comprise at least one of a smart grid selection part, a food management selection part, and a smart diagnosis selection part.

5. The refrigerator according to claim 4, wherein, when the food management selection part is selected, the first display part displays a food position information screen for displaying a position of a stored food, and a food list information screen for displaying a food to be stored.

6. The refrigerator according to claim 5, wherein the food position information screen displays at least one storage information and at least one storing space information within a storage, and the storing space information comprises at least one stored food information for displaying a stored food.

7. The refrigerator according to claim 6, wherein at least one stored food corresponding to the at least one stored food information is deleted or added, and the at least one stored food information is modified.

8. The refrigerator according to claim 5, wherein the food list information screen displays food category information and at least one food display information corresponding to a food category.

9. The refrigerator according to claim 8, wherein the at least one food display information comprises a preset food display information and an added food display information, information about a preset food is prevented to be modified on the food list information screen, and information about an added food is allowed to be modified on the food list information screen.

10. The refrigerator according to claim 5, wherein, when a food displayed on the food list information screen is dragged to the food position information screen, the food is added to the food position information screen.

11. The refrigerator according to claim 4, wherein, when the smart diagnosis selection part is selected, the first display part displays a diagnosis result.

12. The refrigerator according to claim 1, wherein, when a boundary between the first screen and the second screen, or an upper portion of the second screen is touched and pulled down, or when the smart grid function on/off information is selected, a smart grid information screen for selecting an on or off state of the smart grid function is displayed.

13. The refrigerator according to claim 1, wherein, when the smart grid function is turned on, the display part is operated based on energy information.

14. The refrigerator according to claim 1, wherein the second screen displays a smart grid selection button in a state where the smart grid function is turned off, and when the smart grid selection part is selected, a smart grid off notice screen is displayed.

15. The refrigerator according to claim 1, wherein, in a state where the smart grid function is turned on, when the smart grid selection part is selected, an information screen related to power is displayed.

16. The refrigerator according to claim 15, wherein the information screen related to the power comprises at least one of a power cost screen, a power usage cost screen, a power usage amount screen, and a door opening number information screen.

17. The refrigerator according to claim 16, wherein one of the power cost screen, the power usage cost screen, the power usage amount screen, and the door opening number information screen is changed to another one.

18. The refrigerator according to claim 1, wherein an initial screen of the first display part displays information about at least one food stored in the refrigerator.

19. A remote controller for controlling or monitoring a component including at least a refrigerator, the remote controller comprising:

a display part for displaying information about the component; and a control part for controlling an operation of the display part, wherein the display part comprises a first user interface (UI) for remotely controlling the component, and at least one second user interface (UI) for performing a function except for the remotely controlling, when the first user interface is activated, the display part displays a plurality of screens separated by contents, and one of the screens displays a component selection part for selecting the component, wherein the plurality of screens comprise a first screen and a second screen, the first screen displays smart grid function on/off information of a smart grid function, the second screen displays a smart grid selection button, and the smart grid function on/off information is displayed differently according to an on state and an off state of the smart grid function.

20. The remote controller according to claim 19, wherein the first screen further displays at least one of date information or time information.

21. The remote controller according to claim 19, wherein, in a state in a state where the smart grid function is turned on, when a smart grid selection part of the second screen is selected, the second screen displays an information screen comprising power-related information.

22. The remote controller according to claim 21, wherein, when a detailed check selection part displayed on the information screen is selected, at least one of a graph information screen and a text information screen is displayed.

23. The remote controller according to claim 19, wherein, when the refrigerator is selected through the component selection part, the display part displays at least one of a temperature information screen for displaying temperature information, a temperature set selection part for setting a temperature, and a food management selection part for checking a food stored in the refrigerator.

24. The remote controller according to claim 23, wherein, when the food management selection part is selected, the display part displays storage information and a storing space information screen comprising information about at least one storing space within a storage.

25. The remote controller according to claim 24, wherein, when the at least one storing space is selected, information about a food stored in the selected storing space is displayed.

26. The remote controller according to claim 24, wherein, when the food management selection part is selected, the display part further displays a storage position information screen for displaying a position of the storage.

27. The remote controller according to claim 19, wherein when a diagnosis for the selected component is requested, the display part displays a diagnostic result.

* * * * *